US006158842A

United States Patent [19]

Ando et al.

[11] Patent Number: 6,158,842

[45] **Date of Patent: *Dec. 12, 2000**

[54] PRINTER APPARATUS

[75] Inventors: Makoto Ando, Tokyo; Tohru Naganuma, Kanagawa; Takashi Aihara, Chiba; Kenji Okamoto, Tokyo, all of Japan

[73] Assignee: Sony Corporation, Tokyo, Japan

[ * ] Notice: This patent is subject to a terminal disclaimer.

[21] Appl. No.: 08/698,578

[22] Filed: Aug. 15, 1996

[30] Foreign Application Priority Data

Aug. 16, 1995 [JP] Japan ..... 7-208745

[51] Int. Cl.[7] ..... B41J 2/135

[52] U.S. Cl. ..... 347/45; 347/85

[58] Field of Search ..... 347/98, 68, 85, 347/45

[56] References Cited

U.S. PATENT DOCUMENTS

| | | | |
|---|---|---|---|
| 4,368,476 | 1/1983 | Uehara et al. | 347/45 |
| 4,623,904 | 11/1986 | Conta et al. | 347/68 |
| 5,543,827 | 8/1996 | Van Steenkiste et al. | 347/28 |
| 5,777,636 | 7/1998 | Naganuma et al. | 347/10 |

FOREIGN PATENT DOCUMENTS

| | | | |
|---|---|---|---|
| 655337 | 5/1995 | European Pat. Off. . | |
| 4-329151 | 11/1992 | Japan | 347/68 |

*Primary Examiner*—John Barlow
*Assistant Examiner*—Michael S. Brooke
*Attorney, Agent, or Firm*—Sonnenschein, Nath & Rosenthal

[57] ABSTRACT

A printer apparatus having a print head which has a first pressure chamber into which a discharge medium is introduced, a second pressure chamber into which a feed medium is introduced, and at least one set of nozzles comprised of a first nozzle communicated with the first pressure chamber and a second nozzle communicated with the second pressure chamber arranged adjacent to each other and which mixes and discharges the discharge medium and the feed medium from the nozzles, wherein a liquid repellent treatment is applied to at least one of the portion between the mutually adjoining first nozzle and second nozzle and a portion between the sets of nozzles adjoining each other on a nozzle opening face of the print head; wherein a projecting portion is formed on at least one of the portion between the mutually adjoining first nozzle and second nozzle and the portion between the sets of nozzles adjoining each other on the nozzle opening face of the print head; or wherein a recessed portion is formed between the mutually adjoining sets of nozzles of the nozzle opening face of the print head.

6 Claims, 22 Drawing Sheets

PRINTER APPARATUS

BACKGROUND OF THE INVENTION

1. Field of the Invention

The present invention relates to a printer apparatus having a print head which mixes and discharges a discharge medium and a feed medium from a nozzle. In more detail, it relates to a printer apparatus which prevents the discharge medium and feed medium from remaining at the nozzle opening face of the print head and enables the formation of an image having a highly precise expression of tones and a high resolution.

2. Description of the Related Art

In recent years, particularly in offices, preparation of documents using a computer, referred to as "desk-top publishing", is now a frequent practice. Recently, also, there have been increasing requests for the output of not only characters and simple graphics, but also color natural images like photographs together with the characters and graphics. Along with this, there have been demands for printing high quality natural image. Therefore, reproduction of halftones has become important.

Further, so-called "on-demand" type printer apparatuses print an image on a printing medium such as a paper or film with ink droplets discharged from the nozzle only when necessary at the time of printing in accordance with a printing signal. This type of printer apparatuses has been rapidly spreading in recent years since it is possible to reduce their size and cost.

A variety of methods have beer proposed as the method of discharging the ink droplets in this way, but the ones generally used are the method of using a piezoelectric element or the method of using a heat generating element. The former is the method of applying pressure to the ink by the deformation of the piezoelectric element to discharge the ink. The latter is the method of using a heat generating element to heat and cause the ink to boil and cause the ink to discharge by the pressure of the bubbles generated.

A variety of methods have also been proposed as the method of reproducing halftones by the above on-demand type printer apparatuses discharging ink droplets. Namely, as a first method, there can be mentioned a method in which the tone is expressed by controlling the size of the droplets to be discharged by changing the voltage and pulse width of a voltage pulse to be given to the piezoelectric element or the heat generating element, so as to make the diameter of the print dots variable. Note that, at this time, the on-demand type printer apparatus discharges one droplet per one pulse of the voltage.

According to this method, however, when the voltage and pulse width to be given to the piezoelectric element or the heat generating element are made too low, the ink can no longer be discharged, and therefore there is a limit to how small the diameter of the droplets can be made, the number of stages of tones which can be expressed is small, and particularly the expression of a low density is difficult. Thus, this method is insufficient for printing out a natural image.

Further, as a second method, there can be mentioned a method in which one pixel is comprised by a matrix consisting of, for example, 4×4 dots without a change of the dot diameter, and tones are expressed by using the so-called dither method in these matrix units. Note that in this case it is possible to express 17 tones.

Upon printing by this method with, for example, the same dot density as that of the first method, however, the resolution is one fourth of that of the first method, so the roughness is remarkable. Therefore, this method is insufficient to print out a natural image.

In view of this, the present inventors proposed in U.S. patent application Ser. No. 08/622005 now pending a so-called "carrier jet" system printer apparatus wherein the ink is mixed with a diluent when discharging it, so as to change the concentration of the ink droplets to be discharged and enable the control of the density of the dots to be printed and thereby express tones without occurrence of a deterioration of resolution and print out a natural image.

The print head of an on-demand type printer apparatus to which a so-called "carrier jet" system of mixing the ink and diluent and discharging the mixture, as described above, is applied has a first pressure chamber into which a diluent as the discharged liquid is introduced and a second pressure chamber into which an ink as the feed liquid is introduced, and has at least one set of nozzles, each comprised of a first nozzle formed so as to be communicated with the first pressure chamber and a second nozzle formed so as to be communicated with the second pressure chamber adjacent to each other, in a mutually adjoining manner.

Upon printing by the print head, first pressure is applied to the ink in the second pressure chamber by the piezoelectric element or the heat generating element to squeeze out a predetermined amount of ink from the second nozzle toward the first nozzle. Next, the pressure in the second pressure chamber is reduced and the ink is retracted into the second nozzle so that only the predetermined amount of ink remains on the first nozzle side.

Subsequently, pressure is applied to the diluent in the first pressure chamber by the piezoelectric element or the heat generating element, to discharge a mixture of the diluent and the predetermined amount of ink from the first nozzle so as to carry out the printing.

In such a print head, however, after the predetermined amount of ink is squeezed out of the second nozzle and then the ink is retracted, ink sometimes remains between the first nozzle and the second nozzle at the nozzle opening face of the print head.

When the ink remains at the nozzle opening face in this way, it exerts an influence upon the ratio of mixture of the ink and diluent at the next printing, which results in a reduction of the precision of concentration of the droplets of the mixture of ink and diluent, a reduction of the precision of the density and tones of the image formed, and also a reduction of the resolution.

In the above printer apparatus, the density of the dots to be printed is determined according to the ratio of mixture of the ink and the diluent. The tones are expressed by this. Therefore if the ink remains on the nozzle opening face as described above, this remaining ink will exert an influence upon the ratio of mixture of next printing, so that accurate densities of the dots at the next printing and tones of the image to be formed cannot be obtained, and consequently the resolution is deteriorated.

Further, if the ink remains on the nozzle opening face, there exists a possibility that this remaining ink will exert an influence upon the direction of discharge of the mixture and will lower the precision of the image forming position.

Furthermore, if the ink remains on the nozzle opening face, there is a possibility that the diluent in the first nozzle and the ink in the second nozzle will end up being connected by this remaining ink. If the discharge of the feed ink or diluent is carried out so as to perform the next printing in this state, naturally there will be an influence on the ratio of the mixture, result in inaccuracy in the concentration of droplets of the mixture of ink and diluent, and density and tones of the image to be formed, so that a high resolution of the image cannot be obtained.

Further, where the print head has a plurality of sets of nozzles as mentioned above, there also exists a possibility that the ink extruded from the second nozzle of a certain set of nozzles will intrudes into the diluent in the first nozzle in the adjoining set of nozzles and that there will be interference between liquids discharged from adjacent nozzles so that accuracy in density and tones of the formed images, and the resolution are deteriorated.

SUMMARY OF THE INVENTION

The present invention was made in consideration of these circumstances in the related art and has as its object thereof to provide a printer apparatus which prevents the ink from remaining at the nozzle opening face or prevents the interference of ink between sets of nozzles adjoining each other and make it possible to images having a high precision of density and tones and a high resolution.

The present inventors engaged in depth studies so as to achieve the above object and consequently found the fact that the precision of density and tones of the image and the precision of the image formation position can be enhanced, if the residual presence of the ink on the nozzle opening face of the print head, particularly the residual presence of the ink between the nozzles, is prevented.

Further, the present inventors engaged in depth studies and consequently found the fact that the precision of density and tones of the image can be enhanced if the interference of the ink between the adjoining sets of nozzles is prevented.

As the means for preventing the residual presence of ink on the nozzle opening face, a means of applying liquid repellent treatment to the nozzle opening face so that the ink easily returns to the nozzle and a means of forming a projecting portion between the nozzles so that the ink easily returns to the nozzle can be considered. Further, as a means for preventing the interference of the ink between the adjoining sets of nozzles, a means of forming a portion treated to become liquid repellent or a projecting portion or a recessed portion between the adjoining sets of nozzles can be considered.

Namely, the present invention provides a printer apparatus having a print head which has a first pressure chamber into which a discharge medium is introduced, a second pressure chamber into which a feed medium is introduced, and at least one set of nozzles comprising a first nozzle communicated with the first pressure chamber and a second nozzle communicated with the second pressure chamber formed adjacent to each other and which mixes and discharges the discharge medium and the feed medium from the nozzles, wherein a liquid repellent treatment is applied to at least one of the portions between the first nozzle and second nozzle adjoining each other and between the sets of nozzles adjoining each other at the nozzle opening face.

Further, in the present invention, the liquid repellent treatment may be carried out on the entire nozzle opening face of the print head.

Further, in the present invention, in the printer apparatus as mentioned above, the liquid repellent treatment may be applied between the mutually adjoining first nozzle and second nozzle at the nozzle opening face of the print head, and, at the same time, a projecting portion formed therebetween.

Further, in the present invention, in the printer apparatus as mentioned above, the liquid repellent treatment may be applied between the mutually adjoining sets of nozzles at the nozzle opening face of the print head, and, at the same time, a projecting portion or a recessed portion formed therebetween.

BRIEF DESCRIPTION OF THE DRAWINGS

These and other objects and features of the present invention will become clearer from the detailed description of the preferred embodiments given below with reference to the attached drawings, in which.

DETAILED DESCRIPTION OF THE PREFERRED EMBODIMENTS

Figure 1:
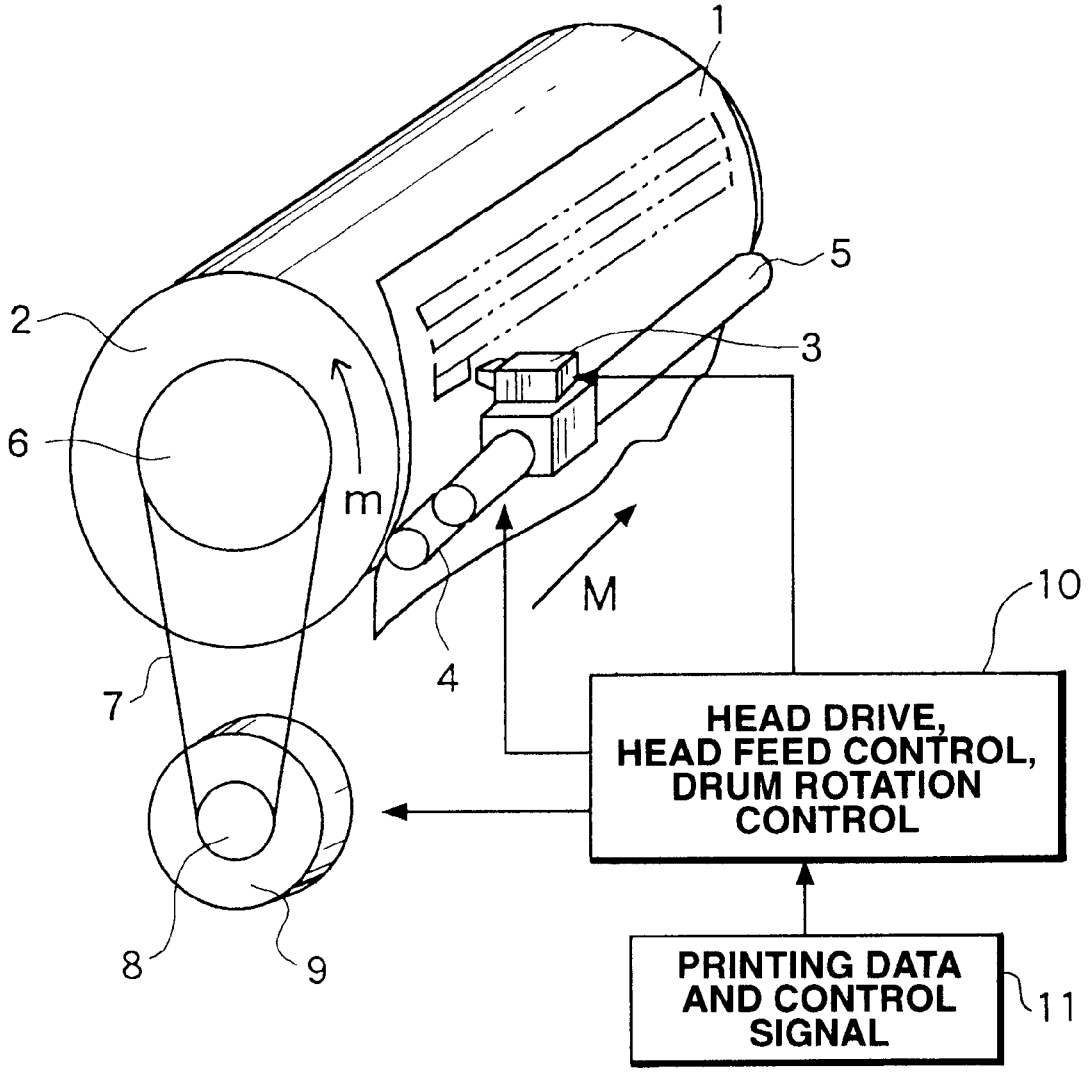
FIG. 1 is a schematic perspective view of principal parts diagrammatically showing one example of a liquid injection recording apparatus in which is mounted a printer apparatus to which the present invention is applied.

Below, a detailed explanation will be made of specific embodiments of the present invention referring to the drawings.

As a liquid injection recording apparatus in which the printer apparatus of the present invention is mounted, a so-called serial type apparatus having the configuration as shown in FIG. 1 can be mentioned. Namely, it is mainly constituted by a drum 2 upon which a print sheet 1 which is the object of printing is supported and a print head 3 which constitutes the printer apparatus of the present invention and performs the printing on the print sheet 1.

At this time, the print sheet 1 is brought into press-contact with the drum 2 and held by this by a press-contacting roller 4 provided parallel to the axial direction of the drum 2. Further, in the vicinity of the outer periphery of the drum 2, a feed screw 5 is provided in parallel to the axial direction of the drum 2. The print head 3 is held upon this feed screw 5. Namely, such a print head 3 moves in the axial direction of the drum 2 as indicated by an arrow M in the figure by the rotation of the feed screw 5.

On the other hand, the drum 2 is driven to rotate by a motor 9 via a pulley 6, a belt 7, and a pulley 8 as indicated by an arrow m in the figure. Further, the rotation of the feed screw 5 and the motor 9 and the print head 3 are controlled by a head drive, head feed control, and drum rotation control 10 based on printing data and a control signal 11.

In the above configuration, when the print head 3 moves and performs one row's worth of the printing, the drum 2 is rotated exactly by an amount of one row to perform the next printing. A case where the print head 3 moves to perform the printing of image includes a case of one direction and a case of a reciprocal direction.

Figure 2:
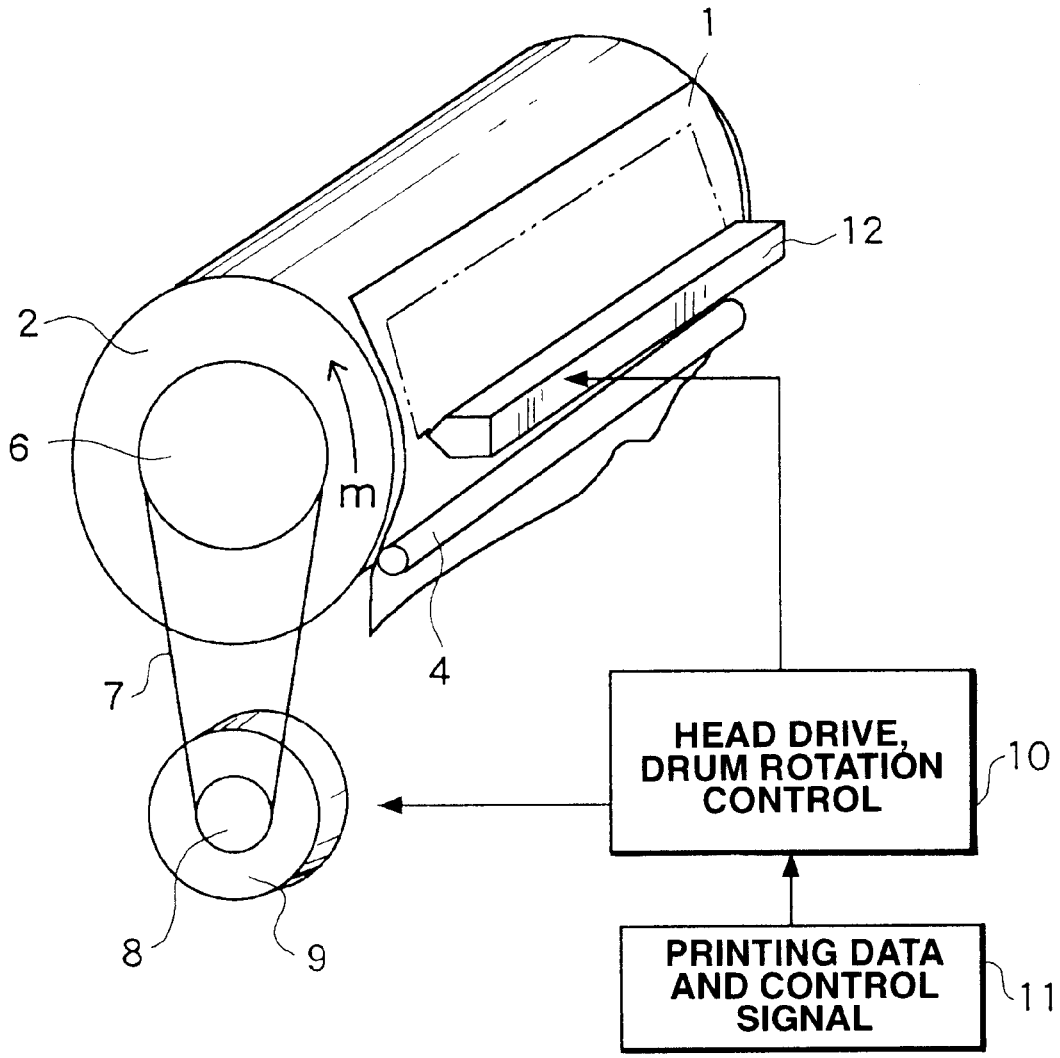
FIG. 2 is a schematic perspective view of principal parts diagrammatically showing another example of the liquid injection recording apparatus in which is mounted a printer apparatus to which the present invention is applied.

As a liquid injection recording apparatus in which the printer apparatus of the present invention is mounted, a so-called line type apparatus having a configuration as shown in FIG. 2 can be mentioned as well. As shown in FIG. 2, this liquid injection recording apparatus has a configuration substantially the same as that of the liquid injection recording apparatus shown in FIG. 1 and is constituted in that a print head assembly 12 is arranged including a plurality of print heads arranged in a fixed manner in the axial direction of the drum 2, in place of the print head 3 which is held by the feed screw 5 and can be moved in the axial direction of the drum 2 by the rotation of this feed screw 5. Namely, in the print head assembly 12, one row's worth of printing is simultaneously carried out. When the one row's worth of printing is carried out, the drum 2 is rotated exactly by the amount of one row to carry out the next printing. Further, in this case, it is also possible, in addition to printing one row's worth together, divide the amount of one row into a plurality of blocks or alternately print for every other row.

Figure 3:
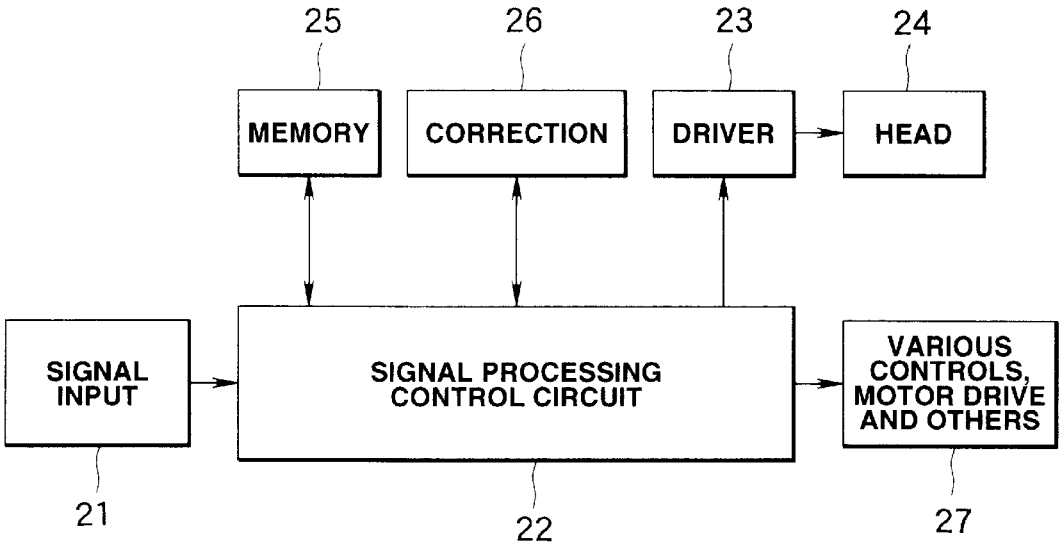
FIG. 3 is a block diagram of a printing and controlling system of an example of the liquid injection recording apparatus in which is mounted a printer apparatus to which the present invention is applied.

A block diagram of the printing and controlling system in such a liquid injection recording apparatus is shown in FIG. 3. A signal input 21 such as the printing data is input to a signal processing control circuit 22, arranged in the order of printing in this signal processing control circuit 22, and sent to a head unit 24 (print head) via a driver 23. The printing order differs depending upon the configuration of the head unit 24 and the printing unit. The order of input of the printing data is also relevant. The data is once recorded in a memory 25 such as a line buffer memory or a screen memory and taken out according to need. A tone signal and discharge signal are input to the head unit 24.

Note that where there are multiple heads and the number of nozzles is very large, an IC is mounted in the head unit 24 to reduce the number of wirings connected to the head unit 24. Further, a correction means 26 is connected to the signal processing control circuit 22, which performs the y-correction, the color correction in the case of color, a correction of variations among the respective heads, etc. Generally the predetermined correction data is stored in the correction means 26 in the form of a ROM map and taken out in accordance with the external conditions, for example, the nozzle number, the temperature, and the input signal.

Generally the signal processing control circuit 22 is of a CPU or DSP configuration and performs processing by software. The processed signal is sent to the various control motor drives and the other means 27. The various control motor drives and the other means 27 perform the control for the driving of the motor for driving the drum and the feed screw to rotate, synchronization, cleaning of the head, supply and ejection of the print paper, etc. Further, needless to say, the signal includes signals for operating units other than the printing data and external control signal.

Figure 4:
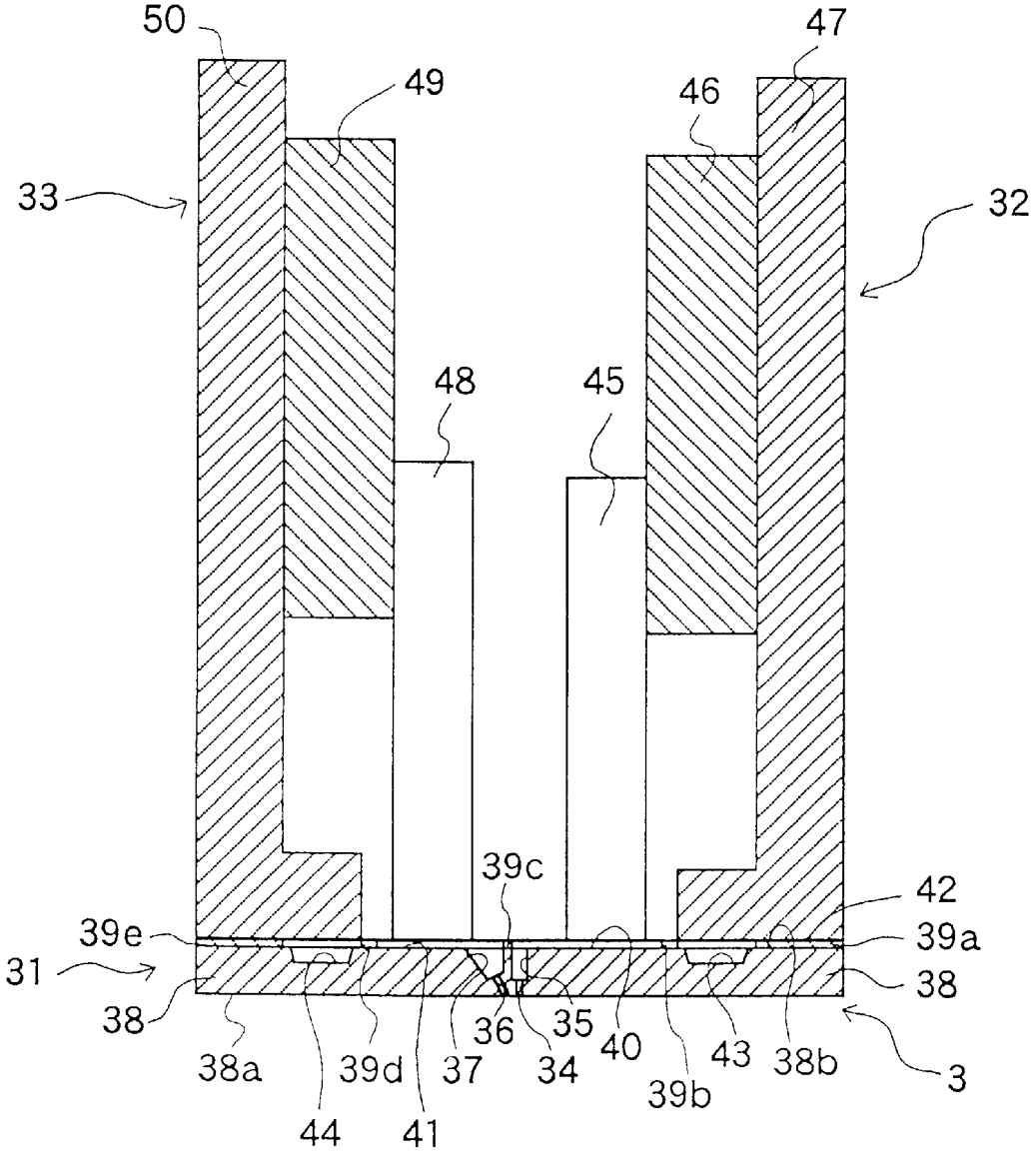
FIG. 4 is a schematic sectional view of principal parts showing an example of the print head of a printer apparatus to which the present invention is applied.

Next, the configuration of the print head 3 constituting the printer apparatus of the present invention will be shown. Note, here, a description will be made of an example of a print head of a printer apparatus of a so-called "carrier jet" system for discharging the ink and the diluent while mixing them, and of an example of a print head having a plurality of sets of nozzles. It is assumed to have a plurality of sets of nozzles corresponding to the configuration of the liquid injection recording apparatus mentioned before. As shown in FIG. 4, the print head 3 is mainly constituted by a pressure chamber unit 31 which mixes and discharges the ink and diluent and has two pressure chambers and a first piezoelectric unit 32 and second piezoelectric unit 33 corresponding to the two pressure chambers.

Figure 5:
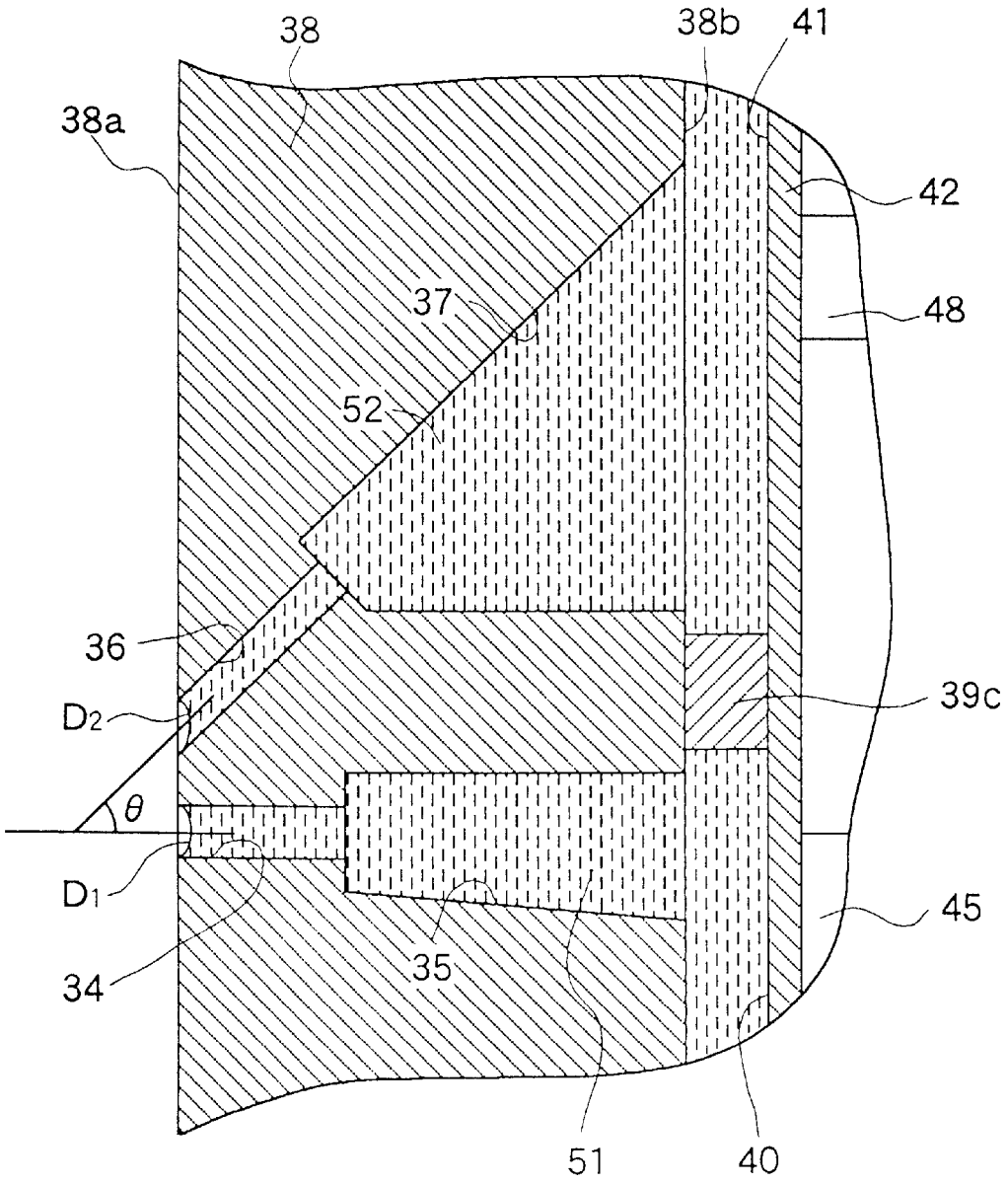
FIG. 5 is a schematic sectional view of principal parts showing in an enlarged manner the vicinity of an orifice plate in one example of a print head of a printer apparatus to which the present invention is applied.

The pressure chamber unit 31 mixes and discharges the ink and the diluent as mentioned above. As shown in FIG. 5 in an enlarged manner, it is constituted by a plate-like orifice plate 38 which forms the nozzle-forming member inside which a first nozzle 34 serving as the diluent discharging port, a first introduction port 35 communicated with this, a second nozzle 36 serving as the ink discharging port, and a second introduction port 37 communicated with this are formed at substantially the center, a first pressure chamber 40 in which pressure chamber side walls 39*a*, 39*b*, 39*c*, 39*d*, and 39*e* are formed as partition walls as shown in FIG. 4 and which becomes the flow passage of the diluent, a second pressure chamber 41 which becomes the flow passage of the ink, and a vibrating plate 42.

In the orifice plate 38, as shown in FIG. 5 in an enlarged manner, one of each of the ends of the first and second nozzles 34 and 36 is made to face one main surface 38*a* acting as the printing surface and one of each of the ends of the first and second introduction ports 35 and 37 communicated with the first and second nozzles 34 and 36 is made to face a back surface 38*b* opposite to the main surface 38*a*. Accordingly, the first introduction port 35 and the first nozzle 34 will penetrate through the orifice plate 38 as a whole, and also the second introduction port 37 and the second nozzle 36 will penetrate through the orifice plate 38 as a whole. Further, the first and second nozzles 34 and 36 are formed so that the angle between the opening directions of them indicated by θ in FIG. 5 becomes 45 degrees. These serve as a set of nozzles.

Further, in the orifice plate 38, as shown in FIG. 4, a first supply chamber 43 having a substantially wide U-shaped cross-section acting as a diluent pool and a second supply chamber 44 having a substantially wide U-shaped cross-section acting as the ink pool are formed so as to sandwich the first and second nozzles 34 and 36 and the first and second, introduction ports 35 and 37 between them, so that the opening surfaces thereof face the back surface 38*b* opposite to the main surface 38*a* acting as the printing surface.

At this time, on the back surface 38*b* side of the orifice plate 38, the pressure chamber side walls 39*a*, 39*b*, 39*c*, 39*d*, and 39*e* are laid and formed as partition walls; the first pressure chamber 40 which connects the opening portion of the first supply chamber 43 and the opening portion of the first introduction port 35 by the part where the pressure chamber side walls 39*a*, 39*b*, 39*c*, 39*d* and 39*e* are not formed and becomes a flow passage is formed; and, at the same time, the second pressure chamber 41 which connects the opening portion of the second supply chamber 44 and the opening portion of the second introduction port 37 and becomes a flow passage is formed.

Then, the vibrating plate 42 is formed laid over the pressure chamber side walls 39*a*, 39*b*, 39*c*, 39*d* and 39*e* to seal the first and second pressure chambers 40 and 41.

Further, as shown in FIG. 4, the first piezoelectric unit 32 is constituted by a plate-like first laminated piezoelectric element 45 in which a piezoelectric material and a conductive material are alternately laminated, a first supporting member 46 affixing one end portion of the first laminated piezoelectric element 45, and a first holder 47 affixing the first supporting member 46 upon which the first laminated piezoelectric element 45 is affixed with respect to the pressure chamber unit 31. The same is true also in the second piezoelectric unit 33. One end of the second laminated piezoelectric element 48 is affixed to the second supporting member 49, and they are affixed with respect to the pressure chamber unit 31 by the second holder 50.

As the first and second laminated piezoelectric elements 45 and 48, any of a piezoelectric element in which the piezoelectric material and the conductive material are laminated in a direction orthogonal to the longitudinal direction of the first and second pressure chambers 40 and 41, and a piezoelectric element in which they are laminated in a direction in parallel to the longitudinal direction can be used. The laminated piezoelectric element has a characteristic that it extends in the laminated direction thereof when a voltage is applied.

For this reason, the former laminated piezoelectric element extends in the longitudinal direction of the first and second pressure chambers 40 and 41 by the application of a voltage, while contracts in the direction orthogonal to this. Such a laminated piezoelectric element is referred to as a laminated piezoelectric element of the d31 mode.

In the latter laminated piezoelectric element, when a voltage is applied, the element extends in a direction orthogonal to the longitudinal direction of the first and second pressure chambers 40 and 41. Such a laminated piezoelectric element is referred to as a laminated piezoelectric element of the d33 mode.

The first laminated piezoelectric element 45 is arranged so as to face the first pressure chamber 40 via the vibrating plate 42, and the second piezoelectric element 48 is arranged so as to face the second pressure chamber 41 via the vibrating plate 42.

Accordingly, in the print head 3 having the above configuration, the diluent is supplied from the not illustrated diluent tank to the first supply chamber 43 after passing through a not illustrated supply pipe and supply groove. It passes through the first pressure chamber 40 from there as shown in FIG. 5 and fills the first nozzle 34 communicated with the first introduction port 35. A first meniscus D1 is formed at the front end portion of the first nozzle 34 by the diluent 51.

The same is true in the case of the ink. The ink is supplied from a not illustrated ink tank to the second supply chamber 44 after passing through a not illustrated supply pipe and supply groove. It then passes through the second pressure chamber 41 from there as shown in FIG. 5 and fills the second nozzle 36 communicated with the second introduction port 37. A second meniscus D2 is formed at the front end portion of the second nozzle 36 by the ink 52.

Further, in the print head 3, as mentioned before, a plurality of sets of nozzles including the first nozzles 34 and the second nozzles 36 are arranged so that they are adjacent to each other. Namely, as shown in FIG. 6, when seen from the main surface 38*a* side of the orifice plate 38 of the print head 3, a plurality of sets of nozzles 60 including the first and second nozzles 34 and 36 are arranged so as to adjoin each other so that the first nozzles 34 are adjacent to each other and the second nozzles 36 are adjacent to each other.

Figure 6:
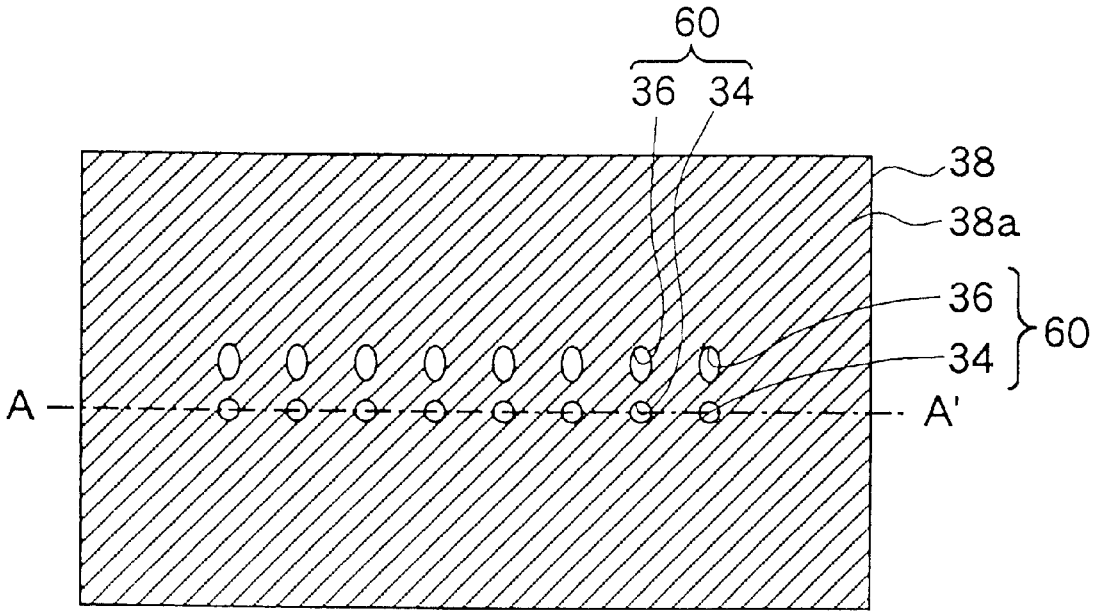
FIG. 6 is a plan view showing an example of a print head of a printer apparatus to which the present invention is applied.
Figure 7:
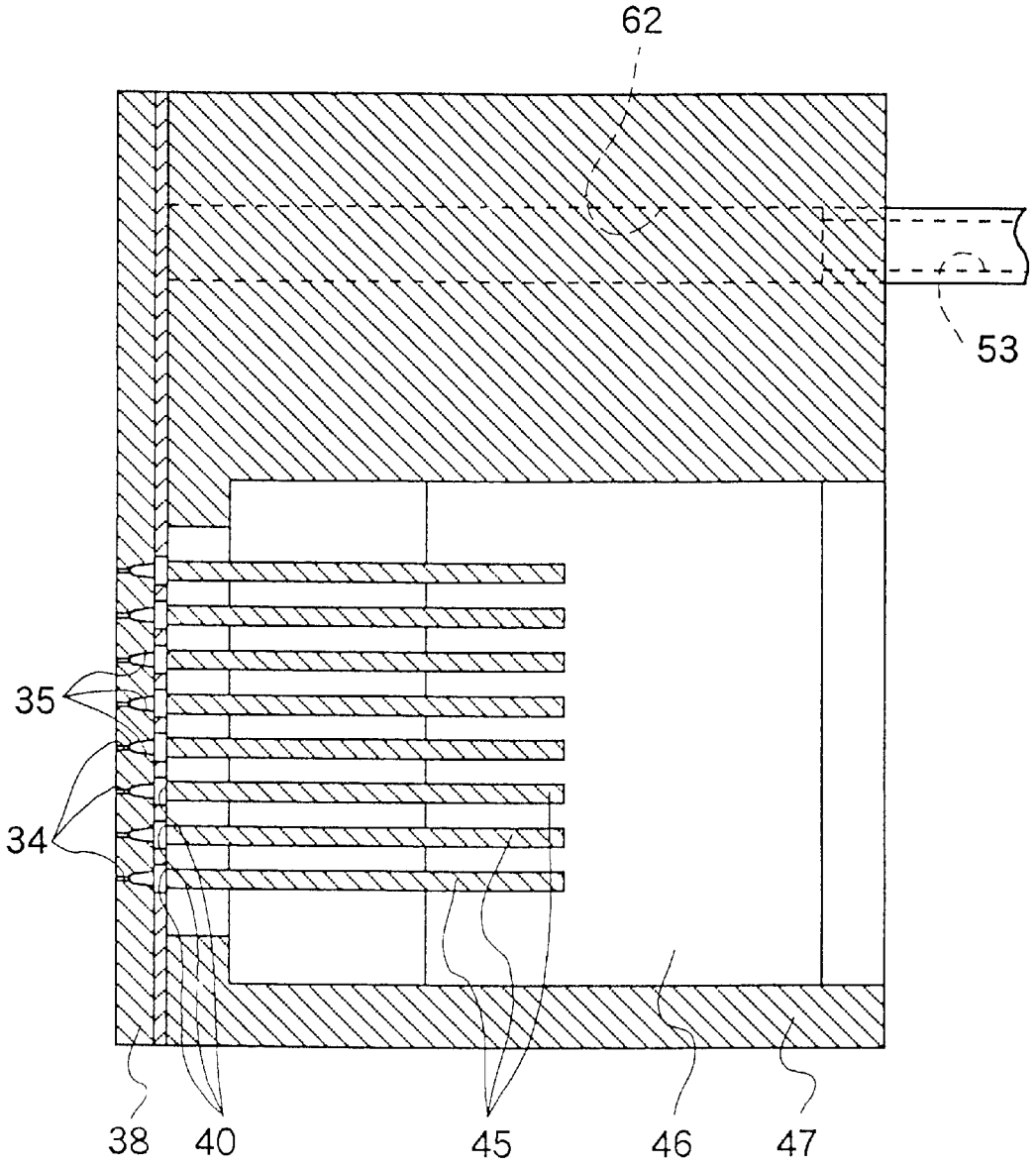
FIG. 7 is a sectional view showing an example of a print head of a printer apparatus to which the present invention is applied.

Further, a sectional view obtained by cutting the print head 3 at a line indicated A—A' in FIG. 6 is shown in FIG. 7 In the orifice plate 38, a plurality of first nozzles 34 communicated with the first introduction port 35 are arranged so that they are adjacent to each other, and also a plurality of first pressure chambers 40 communicated with them are arranged so that they are adjacent to each other. Further, also a plurality of first laminated piezoelectric elements 45 facing a plurality of first pressure chambers 40 are arranged so that they are adjacent to each other. One end of each of these is held upon the supporting member 46, while the supporting member 46 is affixed to the first holder 47.

Note that, in the print head 3 are also formed the first supply pipe 62 which supplies the diluent to the not illustrated first supply chamber supplying, for example, the diluent to these first pressure chambers 40, and a second supply pipe 53 connecting this to the not illustrated diluent tank of the external portion. Further, the same configuration is exhibited also on the second nozzle 36 side of the print head 3.

Figure 8:
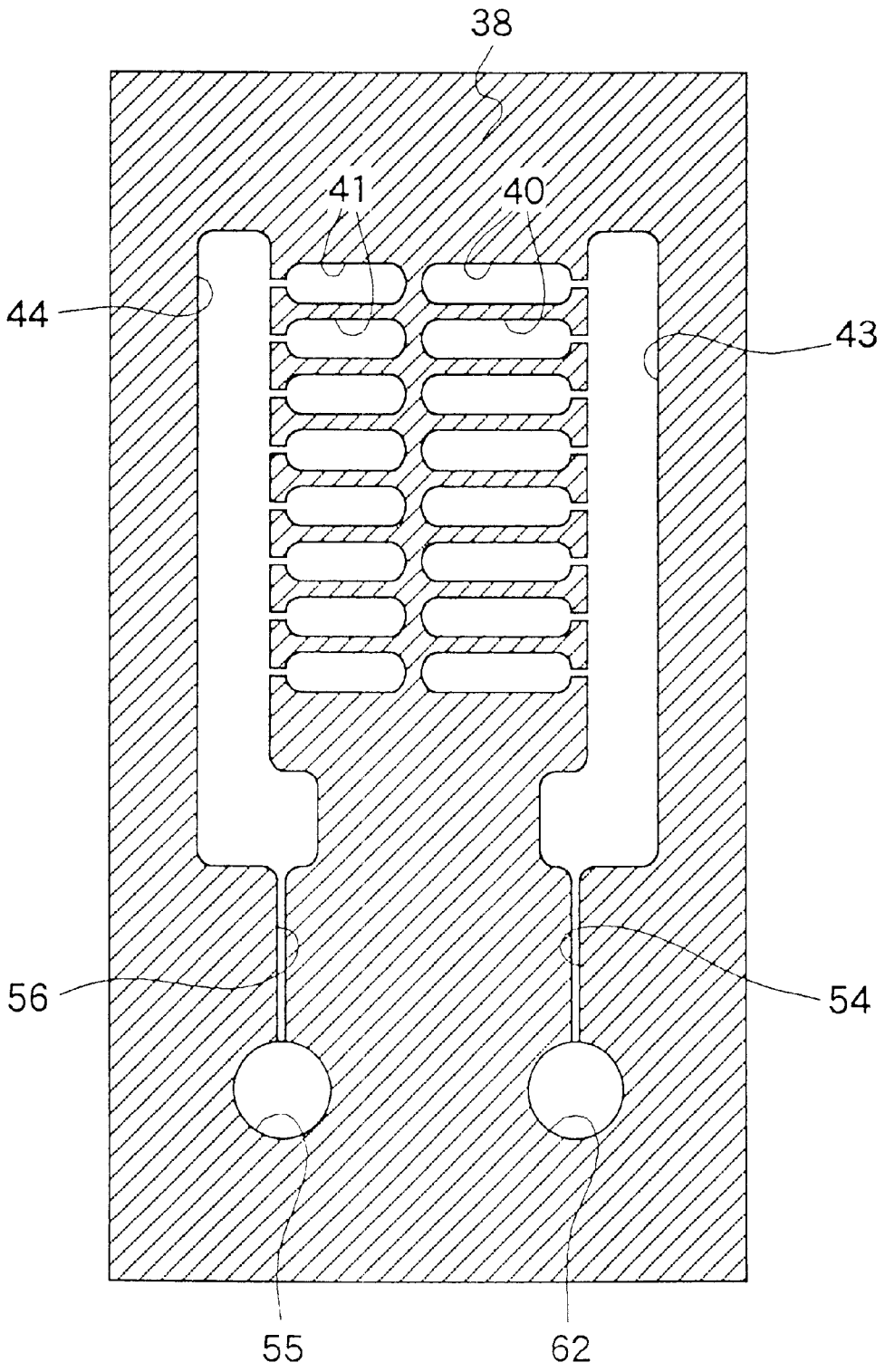
FIG. 8 is a sectional view showing the orifice plate of an example of a print head of a printer apparatus to which the present invention is applied.

Next, a sectional view obtained by cutting the orifice plate 38 in the vicinity of the first and second pressure chambers 40 and 41 is shown in FIG. 8. In this, the first supply chamber 43 is formed in a size that corresponds to the plurality of the first pressure chambers 40 in a corresponding position. These first pressure chambers 40 are connected to the first supply chamber 43. The first supply chamber 43 and the first supply pipe 62 are connected by the first supply groove 54.

On the other hand, the second supply chamber 44 is formed in a size that corresponds to the plurality of second pressure chamber 41 in a corresponding position. These second pressure chambers 41 are connected to the second supply chamber 44. The second supply chamber 44, and a third supply groove 55 are connected by a second supply pipe 56. At this time, the third supply pipe 55 is connected to the ink tank of the external portion by a not illustrated fourth supply pipe similar to the first supply pipe 62.

Figure 9:
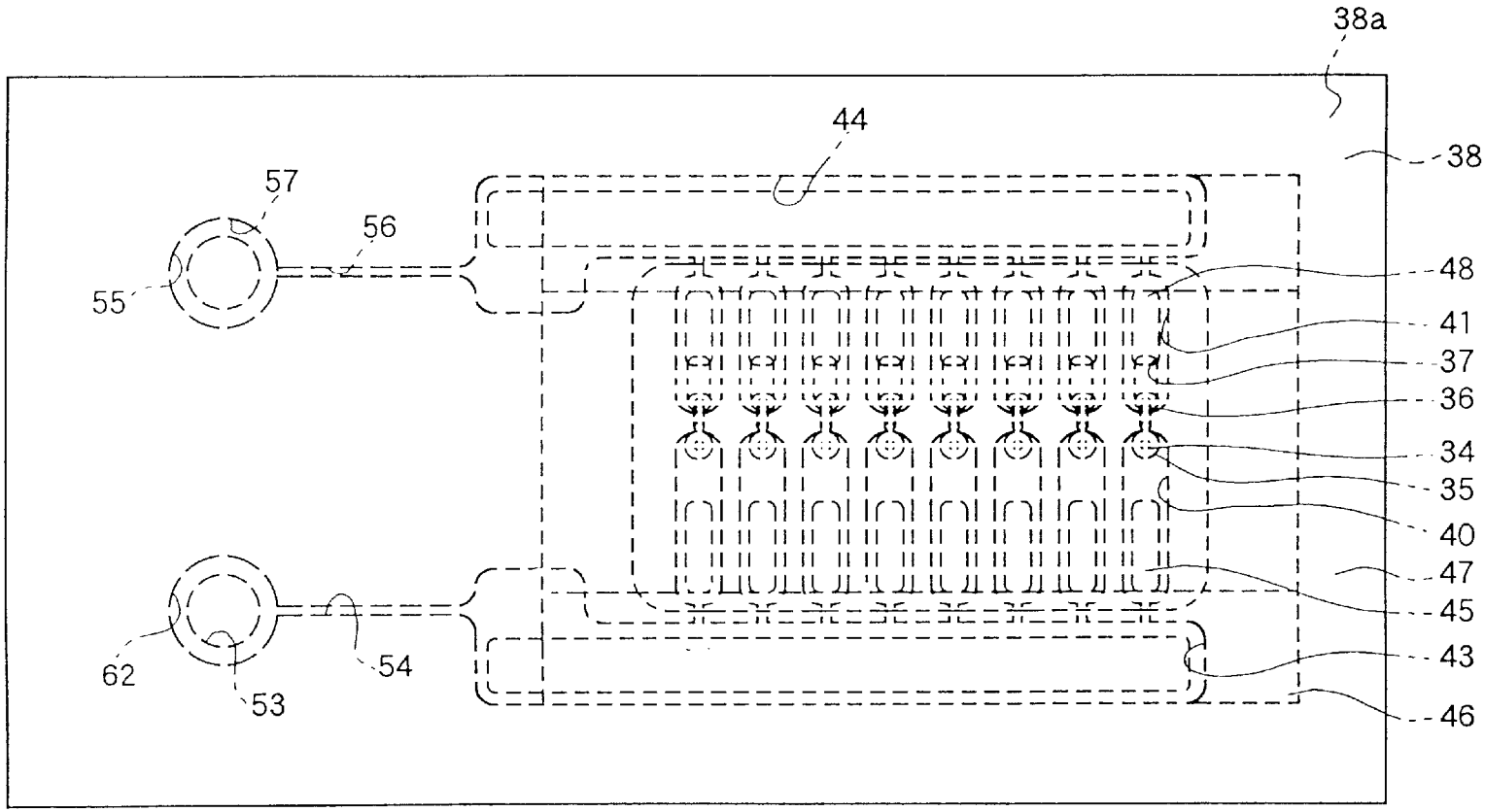
FIG. 9 is a plan view diagrammatically showing an example of a print head of a printer apparatus to which the present invention is applied.

Next, a diagram showing the print head 3 from the main surface 38*a* side of the orifice plate 38 is given in FIG. 9. In the figure, for example, the first nozzles 34 are communicated with the main surface 38*a* side of the first pressure chambers 40 via the first introduction ports 35, and the first laminated piezoelectric elements 45 are arranged at the opposite side to the first nozzles 34 of the first pressure chambers 40.

Accordingly, the diluent supplied from the not illustrated diluent tank via the second supply pipe 53 and the first supply pipe 62 and via the first supply groove 54 to the first supply chamber 43 is supplied to the plurality of first pressure chambers 40, respectively, and filled in the first nozzles 34 communicated with the first introduction ports 35 corresponding to the first pressure chambers 40. Then, when the first laminated piezoelectric elements 45 corresponding to the first pressure chambers 40 are deformed and the first pressure chambers 40 are pressurized, the diluent will be discharged from the first nozzles 34 communicated with the first pressure chambers 40 at the opposite side to the first laminated piezoelectric elements 45.

Namely, when all of the plurality of first laminated piezoelectric elements 45 are deformed and the plurality of first pressure chambers 40 are pressurized, the diluent is discharged from a plurality of first nozzles 34 at one time. When a selected first laminated piezoelectric element 45 is deformed, the diluent will be discharged from the selected first nozzle 34 corresponding to this.

This is true also on the second pressure chamber 41 side. The second nozzles 36 are communicated with the main surface 38*a* side of the second pressure chambers 41 via the second introduction ports 37, and the second laminated piezoelectric elements 48 are arranged at the opposite side to the second nozzles 36 of the second pressure chambers 41.

Accordingly, the ink supplied from the not illustrated ink tank via the fourth supply pipe 57 and the third supply pipe 56 and via the second supply groove 56 into the second supply chamber 44 is supplied to a plurality of second pressure chambers 41 and filled in the second nozzles 36 communicated with the second introduction ports 37 corresponding to the second pressure chambers 41. Then, when the second laminated piezoelectric elements 48 corresponding to the second pressure chambers 41 are deformed and the second pressure chambers 41 are pressurized, the ink will be respectively discharged from the second nozzles 36 communicated with the second pressure chambers 41 at the side opposite to the second laminated piezoelectric elements 48.

Namely, when all of the plurality of second laminated piezoelectric elements 48 are deformed and the plurality of second pressure chambers 41 are pressurized, the diluent is discharged from a plurality of second nozzles 36 at one time, and when a selected second laminated piezoelectric element 48 is deformed, the ink will be discharged from the selected second nozzle 36 corresponding to this.

Figure 10A:
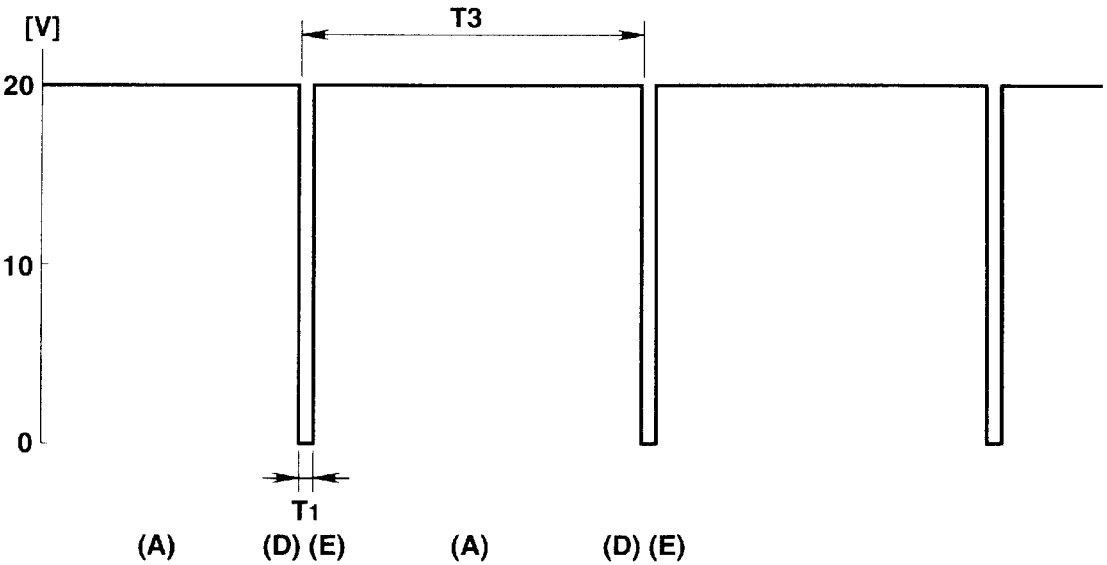
FIGS. 10A and 10B are graphs showing a timing of application of a driving voltage in an example of a print head of a printer apparatus to which the present invention is applied.
Figure 10B:
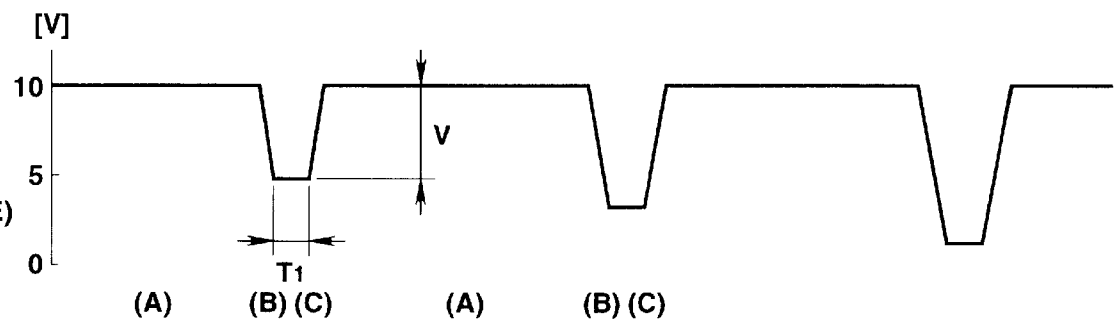

The timing of application of the driving voltage in a case where the printing is carried out by the liquid injection recording apparatus having such a configuration, for example, a case where the laminated piezoelectric elements of the so-called d31 mode are used as the first and second laminated piezoelectric elements 45 and 48, will be shown in FIGS. 10A and 10B.

Figure 11:
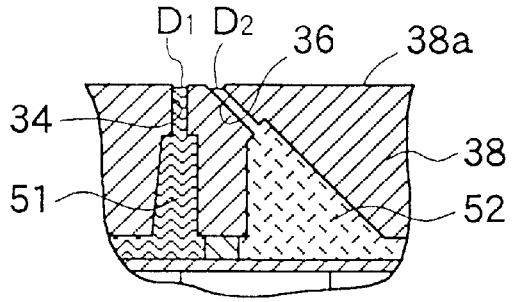
FIG. 11 shows the operation of a print head of a printer apparatus to which the present invention is applied at the time of printing in order of operation, and, is a sectional view diagrammatically showing a state where first and second menisci are formed at the first and second nozzles.

Namely, as shown in FIG. 10A, at the waiting period before the printing, at the point of time indicated by (A) in the figure, for example 20V is preliminarily applied to the first laminated piezoelectric element 45, and as shown in FIG. 10B, at the waiting period before the printing, at the point of time indicated by (A) in the figure, for example 10V is preliminarily applied to the second laminated piezoelectric element 48. A view obtained by diagrammatically enlarging the vicinity of the first and second nozzles 34 and 36 at this time is shown in FIG. 11, in which the first meniscus D1 is formed on the main surface 38*a* side of the first nozzle 34 formed on the orifice plate 38, and the second meniscus D2 is formed on the main surface 38*a* side of the second nozzle 36.

Figure 12:
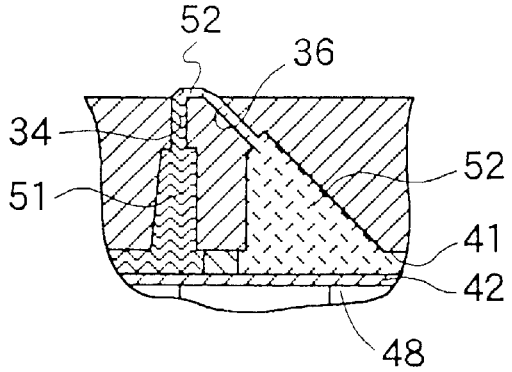
FIG. 12 shows the operation of a print head of a printer apparatus to which the present invention is applied at the time of printing in an order of operation and is a sectional view diagrammatically showing a state where the ink is combined with the diluent of the first nozzle.

Then, at the printing, based on the signals from the head drive, head feed control, and the drum rotation control means 10, first, so as to squeeze out the ink 52 by extruding the ink from the second nozzle 36, at the point of time indicated by (B) in FIG. 10B, the voltage of the second laminated piezoelectric element 48 is gradually lowered to 5V, and held in this state for example 150 μsec. Then, the second laminated piezoelectric element 48 gradually extends in the longitudinal direction, and as diagrammatically shown in FIG. 12, the second pressure chamber 41 is gradually pressurized via the vibrating plate 42, inner pressure is added to the second nozzle 36, and the ink 52 is squeezed out from the outside of the second nozzle 36 to near the opening of the first nozzle 34 and combined with the diluent 51 of the first nozzle 34.

Thereafter, so as to lead the ink 52 into the second nozzle 36 and leave only the feed ink near the opening of the first nozzle 34, the voltage of the second laminated piezoelectric element 48 is gradually returned to 10V at the point, of time indicated by (C) in FIG. 10B. Then, the second laminated piezoelectric element 48 gradually contracts in the longitudinal direction, the inner pressure of the second nozzle 36 is released, and the ink 52 tries to return into the second nozzle 36. By this, only the feed ink remains near the opening of the first nozzle 34.

Figure 13:
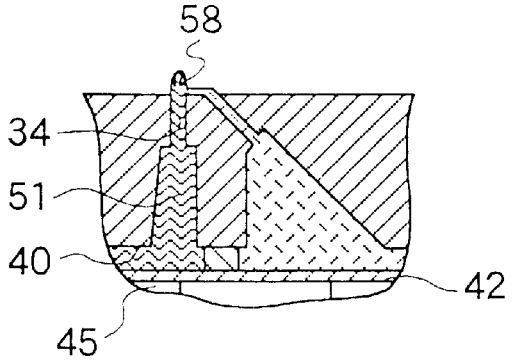
FIG. 13 shows the operation of a print head of a printer apparatus to which the present invention is applied at the time of printing in an order of operation and is a sectional view diagrammatically showing a state where a mixture of the diluent and the ink is formed.

Next, so as to discharge the diluent 51 from the first nozzle 34, as shown in FIG. 10A, the voltage of the first laminated piezoelectric element 45 is brought to for example 0V at the point of time indicated by (D) in the figure. Then, the first laminated piezoelectric element 45 extends in the longitudinal direction, the first pressure chamber 40 is pressurized via the vibrating plate 42, and the inner pressure is applied to the first nozzle 34. As a result, as diagrammatically shown in FIG. 13, the diluent 51 is extruded by the inner pressure in the first nozzle 34, and a mixture 58 of this diluent and the ink remaining near the opening of the first nozzle 34 is formed.

Figure 14:
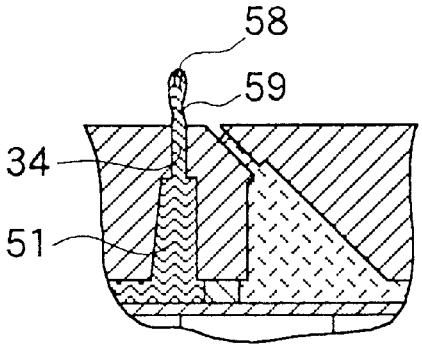
FIG. 14 shows the operation of the print head of the printer apparatus to which the present invention is applied at the time of printing in an order of operation and is a sectional view diagrammatically showing a state where a constriction is caused in the mixture.
Figure 15:
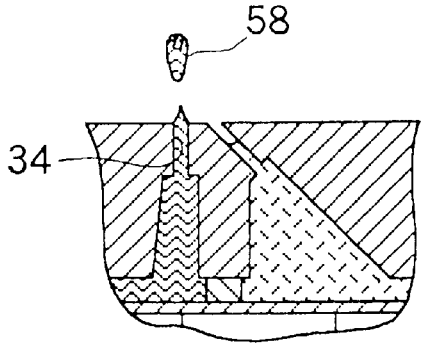
FIG. 15 shows the operation of the print head of the printer apparatus to which the present invention is applied at the time of printing in an order of operation and is a sectional view diagrammatically showing a state where the mixture is discharged from the first nozzle.
Figure 16:
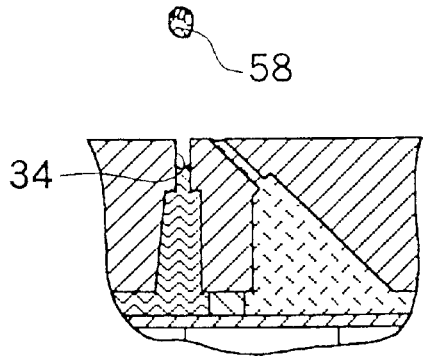
FIG. 16 shows the operation of a print head of a printer apparatus to which the present invention is applied at the time of printing in an order of operation and is a sectional view diagrammatically showing a state where the mixture flies out as a spherical droplet.

Next, when the voltage is made 0V for example for 50 μsec from the point of time indicated by (D) in FIG. 10A and the voltage of the first laminated piezoelectric element 45 is returned to for example 20V at the point of time indicated by (E) in FIG. 10A, the first laminated piezoelectric element 45 contracts in the longitudinal direction, the inner pressure of the first nozzle 34 is released, and the diluent 51 tries to return into the first nozzle 34. By this, as diagrammatically shown in FIG. 14, a constriction 59 is generated between the diluent 51 and mixture 58 in the first nozzle 34, finally the mixture 58 is discharged from the first nozzle 34 as diagrammatically shown in FIG. 15, the mixture 58 flies as the spherical droplet as diagrammatically shown in FIG. 16, and this is coated on the print sheet 1 to carry out the printing.

The inner pressure of the first and second pressure chambers 40 and 41 returns to the original pressure before long, the diluent 51 and ink 52 are filled in the first and second nozzles 34 and 36 again, and a state shown in FIG. 11 is exhibited.

Note that, the ink feed pulse width indicated by T1 in FIG. 10B between the point of time indicated by (B) in the figure and the point of time indicated by (C) in the figure, the diluent discharge pulse width indicated by T2 in FIG. 10A between the point of time indicated by (D) in the figure and the point of time indicated by (E) in the figure, and the ink feed voltage indicated by V in FIG. 10B are variable.

Then, as shown in FIG. 10A and FIG. 10B, the printing is carried out by repeating the above operation. The cycle of printing indicated by T3 in FIG. 10A may be set to for example 1 msec.

Note that, in the print head 3, the orifice plate 38, the pressure chamber side walls 39*a*, 39*b*, 39*c*, 39*d*, and 39*e*, and the vibrating plate 42 may be formed using a resin such as a polysulfone, a dry film photoresist, and a metal plate such as nickel, respectively. Further, the orifice plate 38 may be formed by injection molding the resin as described above, and the first and second nozzles 34 and 36 may be formed by excimer laser processing or the like.

Further, as the diluent 51, a colorless transparent liquid is preferred. There can be mentioned water, an organic solvent, a mixture of them, and further this type of solution containing a viscosity adjusting agent, a surface tension adjusting agent, a preservative, a pH adjusting agent, etc.

On the other hand, as the ink 52, an ink in which an water-soluble paint or pigment is dissolved or dispersed in water or a solvent or a mixture of them is preferred. Then, according to need, it is possible to include in such a solution a viscosity adjusting agent, a surface tension adjusting agent, a preservative, a pH adjusting agent, etc.

Figure 17:
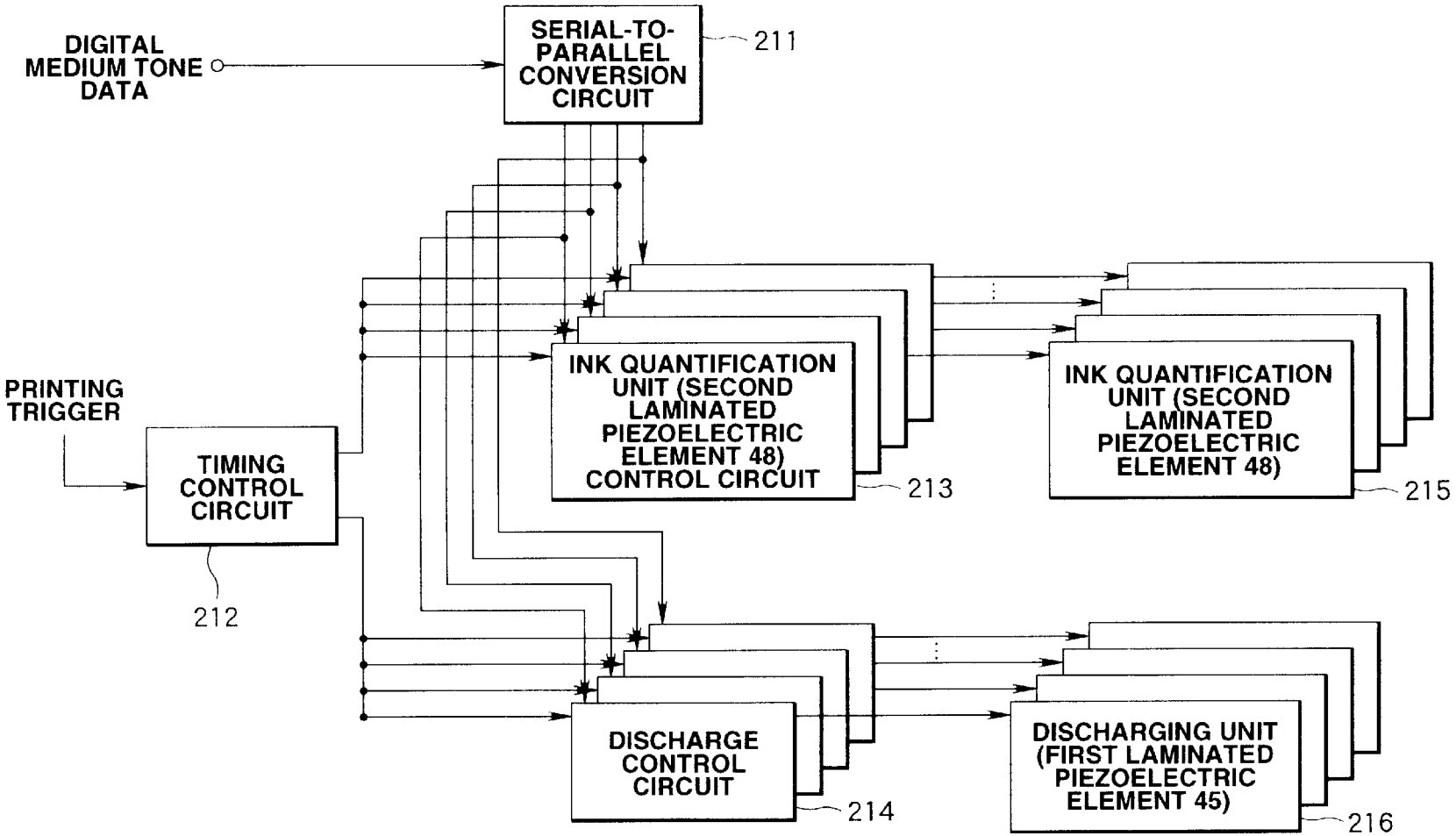
FIG. 17 is a circuit block diagram showing a driving circuit of a print head of a printer apparatus to which the present invention is applied.

Next, a driving circuit of the print head is shown in FIG. 17. Namely, the digital halftone data is supplied from another block and sent to the ink feed unit (second laminated piezoelectric element 48) control circuit 213 and a discharge control circuit 214 by a serial-to-parallel conversion circuit 211. Where the digital halftone data given from the serial-to-parallel conversion circuit 211 is less than a predetermined threshold value, the ink feed and the discharge are not carried out. When it becomes the printing timing, the printing trigger is output from the other block and the timing control circuit 212 detects this and outputs the ink feed unit control signal and the discharge control signal to the ink feed unit (second laminated piezoelectric element 48) control circuit 213 and the discharge control circuit 214 at the predetermined timing, respectively. The signals are output at the timings previously shown in FIG. 10. According to this, the predetermined voltage is applied to the ink feed unit (second laminated piezoelectric element 48) 216 and the discharging unit (first piezoelectric element 45) 216.

Then, in the print head of the printer apparatus of the present example, as shown in FIG. 6, a liquid repellent treatment is applied to the entire surface of the main surface 38*a* which serves as the printing surface of the orifice plate 38 as indicated by the hatching in FIG. 6. The liquid repellent treatment may be carried out by coating for example a fluorine-based resin or the liquid repellent treatment is carried out by forming a metal having a high liquid repellency such as gold by sputtering, evaporation, or the like.

Where coating a fluorine-based resin for the liquid repellent treatment, the orifice plate 38 is produced by the method as mentioned above, then the back surface 38*b* which is opposite to the main surface 38*a* of the orifice plate 38 is masked by a tape or the like, the orifice plate 38 is dipped in a coating agent of a fluorine-based resin, the coating agent is spread over the main surface 38*a* of the orifice plate 38, and then this is dried so as to thereby apply a liquid repellent treatment by the fluorine-based resin to the main surface 38*a* of the orifice plate 38.

Note that, at this time, since nozzles etc. are also formed on the orifice plate 38, the liquid repellent treatment will be applied to the internal portion of the nozzles too. Further, the thickness of the coating of the liquid repellent treatment as described above is greatly affected by the viscosity of the fluorine-based resin, but preferably is set to about 2 μm so as not to close the nozzles. Further, the masking is carried out for the back surface 38*b* as mentioned above so as to ensure the bonding property of the dry film resist where the pressure chamber side walls 39*a*, 39*b*, 39*c*, 39*d*, and 39*e* are formed by the dry film resist or the like in the later manufacturing step.

Accordingly, in the printer apparatus of the present example, since the liquid repellent treatment is applied to the entire surface of the main surface 38*a* which serves as the printing surface of the orifice plate 38 of the print head 3, of course the liquid repellent treatment is applied also to the portions between the first and second nozzles 34 and 36 and the portions between the sets of nozzles 60 adjoining each other.

Namely, in the printer apparatus of the present example, so as to leave only the feed ink near the opening of the first nozzle 34, when retracting the ink into the second nozzle 36, the ink is repelled by the liquid repellent treatment, the feed part and the retracted part are completely separated, and the retracted part easily returns into the second nozzle 36, therefore any connection of the ink and diluent between nozzles is prevented.

Accordingly, in the printer apparatus of the present example, at the next printing, the ink and the diluent are mixed with a correct ratio of mixture, dots having a good precision of density are formed, and an image having a high precision of density and tones and a high resolution is formed.

Accordingly, in the printer apparatus of the present example, the ink discharged from a certain set of nozzles will not easily pass over to the neighboring set of nozzles, an interference of ink between the neighboring sets of nozzles is prevented, and, also due to this, an image having a high precision of density and tones and a high resolution is formed.

Further, in the printer apparatus of the present example, dots having a good precision of forming position are formed without exerting an influence upon the direction of discharge of the mixture at the next printing, and an image having a good precision of forming position is formed.

In the printer apparatus of the present invention, it is also possible to use the print head, as mentioned below, in addition to the print head in which a liquid repellent treatment is applied over the entire surface of the main surface which serves as the printing surface of the orifice plate as mentioned above.

Figure 18:
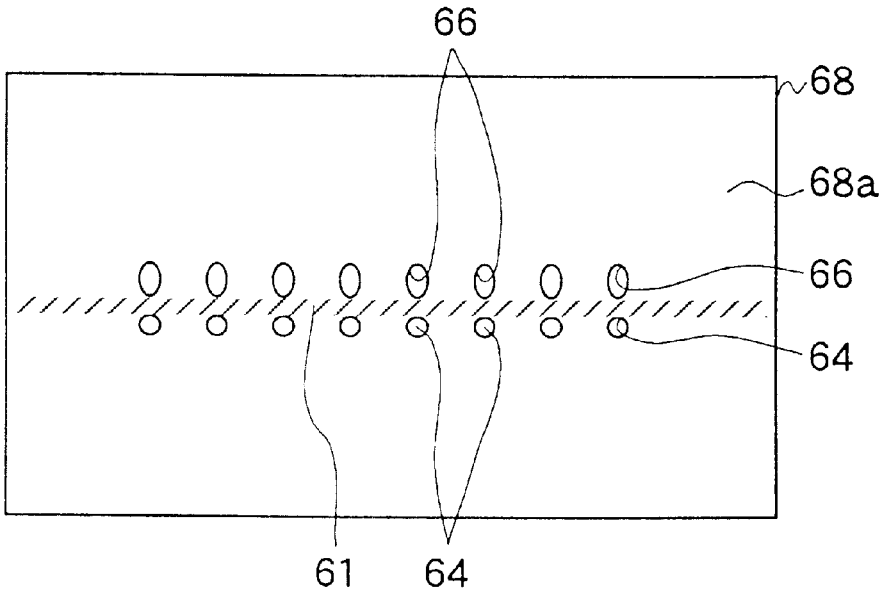
FIG. 18 is a plan view showing another example of a print head of a printer apparatus to which the present invention is applied.

Namely, as shown in FIG. 18, it is also possible to use a print head in which the liquid repellent treated portions 61 to which the liquid repellent treatment was applied as indicated by a hatching portion in the figure are formed between a plurality of first nozzles 64 adjoining each other and a plurality of second nozzles 66 arranged adjoining to each other at the main surface 68*a* which serves as the printing surface of the orifice plate 68 of the print head.

Also in such a printer apparatus, when the ink is retracted into the second nozzle 66, the ink is repelled by the liquid repellency processed unit 61, the retracted portion easily returns into the second nozzle 66, and excessive ink does not remain. Therefore at the next printing, the ink and the diluent are mixed at a correct ratio, and an image having a high precision of density and tones and high resolution is formed.

Further, also in such a printer apparatus, since the liquid repellent treated portion 61 as described above is formed between the first nozzle 64 and the second nozzle 66 adjoining each other, the connection of the ink and the diluent between the first and second nozzles 64 and 66 is prevented. Due to this as well, an image having a high precision of density and tones and high resolution is formed.

Further, also in the printer apparatus of the present example, an image having a good precision of formation position is formed without exerting an influence upon the direction of discharge of the mixture at the next printing.

Figure 19:
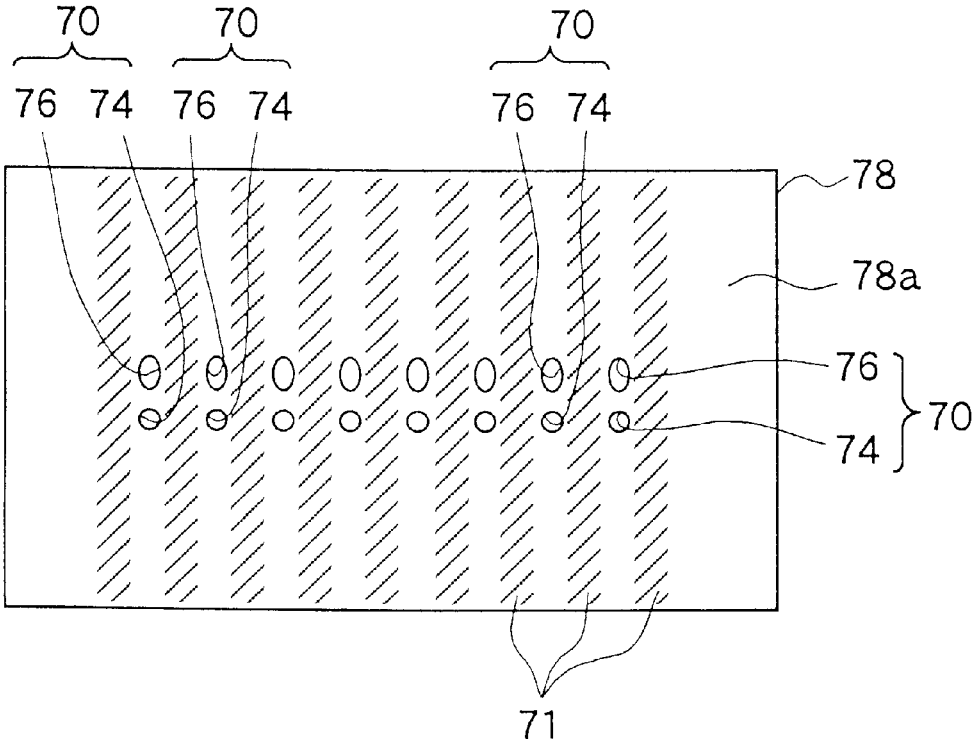
FIG. 19 is a plan view showing still another example of a print head of a printer apparatus to which the present invention is applied.

Further, as shown in FIG. 19, it is also possible to form a plurality of liquid repellent treated portions 71 applied with the liquid repellent treatment as indicated by the hatching portions in the figure among a plurality of adjacent sets of nozzles 70, each composed of a first nozzle 74 and a second nozzle 76, on the main surface 78*a* acting as the printing surface of the orifice plate 78 of the print head. Note that, at this time, preferably a liquid repellent treated portion 71 is formed also on the outside of the set of nozzles 70 which becomes the front end.

In such a printer apparatus, the ink discharged from the second nozzle 76 of a certain set of nozzles 70 is repelled by the liquid repellent treated portion 71 and is not mixed into the diluent in the first nozzle 74 of the neighboring set of nozzles 70, the interference of ink between the mutually adjoining sets of nozzles is prevented, the ink and the diluent are mixed with the correct ratio of mixture at the next printing, dots having a good precision of density are formed, and an image having a high precision of density and tones and high resolution is formed.

Further, in the printer apparatus of the present example, dots having a good precision of formation position are formed without exerting an influence upon the direction of discharge of the mixture at the next printing, and an image having a good precision of formation position is formed.

Figure 20:
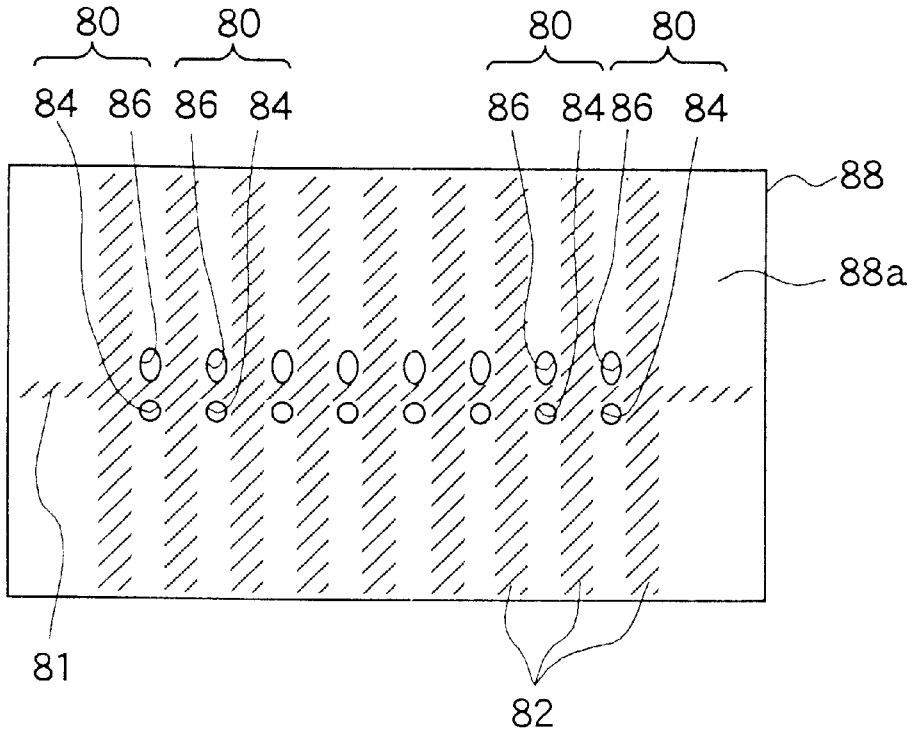
FIG. 20 is a plan view showing still another example of a print head of a printer apparatus to which the present invention is applied.

Further, as shown in FIG. 20, it is also possible to form first liquid repellent treated portions 81 applied with the liquid repellent treatment, as indicated by the hatching portions in the figure, between a plurality of adjacent first nozzles 84 and a plurality of adjacent second nozzles 86 of the main surface 88*a* which becomes the printing surface-of the orifice plate 88 of the print head and, at the same time, form a plurality of second liquid repellent treated portions 82 applied with the liquid repellent treatment, as indicated by the hatching portions in the figure, among a plurality of adjoining sets of nozzles 80 constituted of the first nozzles 84 and the second nozzles 86. Note that, at this time, preferably a second liquid repellent treated portion 82 is formed also on the outside of the set of nozzles 80 which becomes the front end portion.

Even in such a printer apparatus, when the ink is retracted into a second nozzle 86, the ink is repelled by the first liquid repellent treated portion 81, the retracted portion easily returns into the second nozzle 86, and excessive ink does not remain. Therefore, at the next printing, the ink and the diluent are mixed at a correct ratio, and an image having a high precision of density and tones and high resolution is formed.

Further, also in such a printer apparatus, since the first liquid repellent treated portion 81 as described above is formed between the first and second nozzles 84 and 86 adjoining each other, the connection of the ink and the diluent between the nozzles is prevented. Due to this, an image having a high precision of density and tones and high resolution is formed. Further, in the printer apparatus, since the second liquid repellent treated portion 82 is formed between the sets of nozzles 80 adjoining each other and the interference of the ink between the mutually adjoining sets of nozzles is prevented, an image having a high precision of density and tones and high resolution is formed.

Further, also in the printer apparatus of the present example, an image having a good precision of formation position is formed without exerting an influence upon the direction of discharge of the mixture at the next printing.

Figure 21:
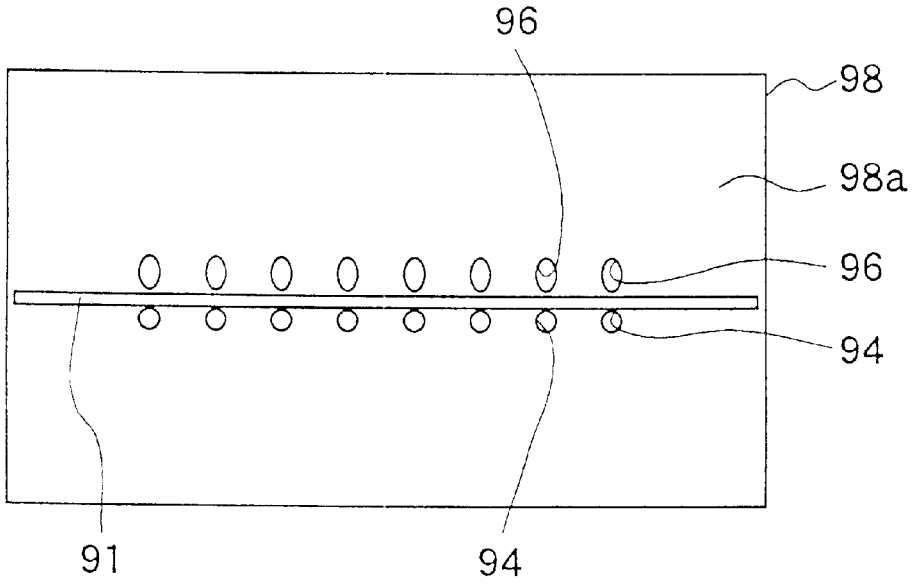
FIG. 21 is a plan view showing still another example of a print head of a printer apparatus to which the present invention is applied.
Figure 22:
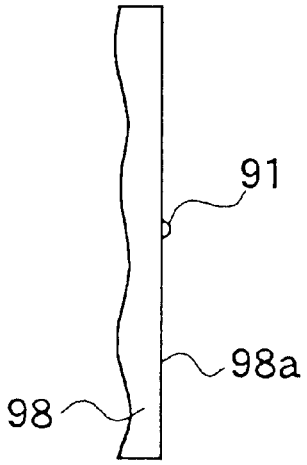
FIG. 22 is a side view showing still another example of a print head of a printer apparatus to which the present invention is applied.

Furthermore, as shown in FIG. 21 and FIG. 22, it is also possible to form projecting portions 91 between a plurality of first nozzles 94 arranged adjoining each other and a plurality of second nozzles 96 arranged adjoining each other at the main surface 98*a* which becomes the printing surface of the orifice plate 98 of the print head. Note that, the projecting portions may be simultaneously formed when the orifice plate 98 is produced by injection molding or the like.

The projecting portions 91 have a continuous curved cross-section and exhibit a so-called mountain shape having a smooth inclination over a direction from the top 91*a* to the foot. Projecting portions having a height of about 1 μm to 100 μm, indicated by H1 in the figure, from the main surface 98*a* to the top 91*a* are preferred.

In such a printer apparatus, if the ink passes over the projecting portion 91 when the ink is extruded to the first nozzle 94 side, the ink easily reaches the first nozzle 94 side. Further, when the ink is retracted into the second nozzle 96, the ink is pushed and returned to the projecting portion 91, the feed portion and the retracted portion are completely separated, and the retracted portion easily returns into the second nozzle 96. Accordingly, from these facts, in the above printer apparatus, excessive ink does not remain on the main surface 98*a* of the orifice plate 98, the ink and the diluent are mixed at a correct ratio at the next printing, and an image having a high precision of density and tones and high resolution is formed.

Further, when the height of the projecting portion 91 is too high, the feed of the ink becomes difficult, while if it is too low, the separation of the feed portion and the retracted portion becomes difficult, therefore the height of the projecting portion 91 is preferably determined within the range as mentioned before.

Further, in the printer apparatus, since a projecting portion 91 as described above is formed between the first nozzle 94 and the second nozzle 96 adjoining each other, the connection of the ink and diluent between the first and second nozzles 94 and 96 is prevented, and, also from this, an image having a high precision of density and tones and high resolution is formed.

Further, also in the printer apparatus of the present example, an image having a good precision of formation position is formed without exerting an influence upon the direction of discharge of the mixture at the next printing.

Figure 24:
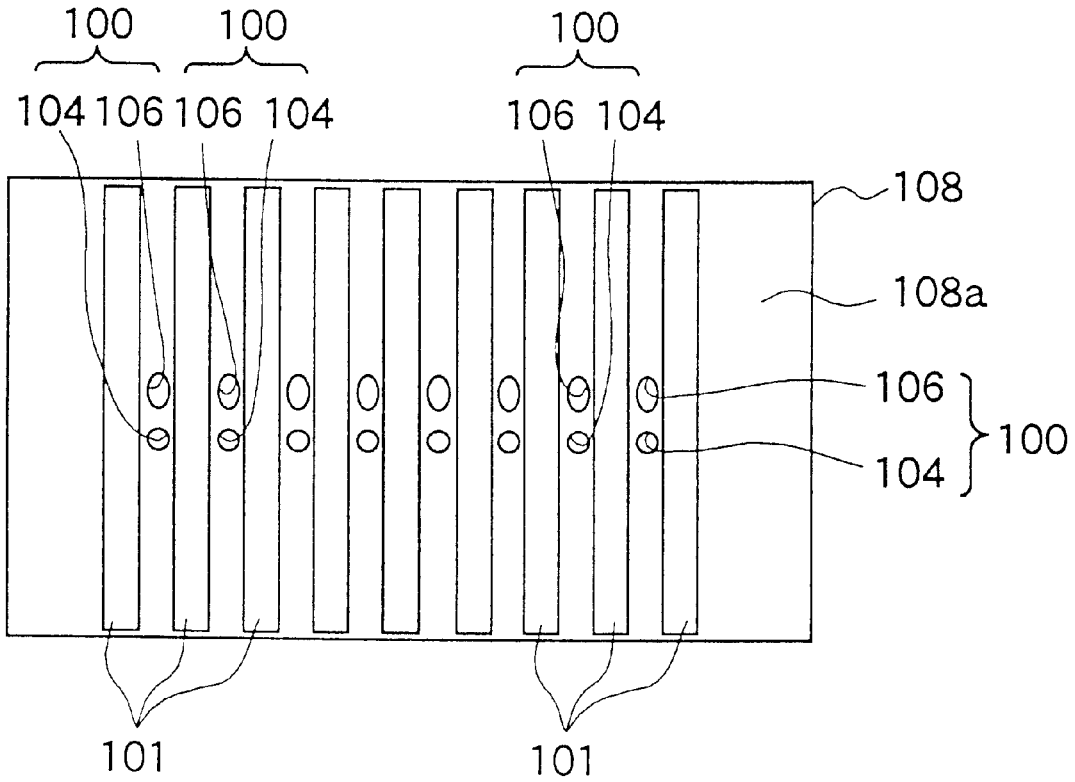
FIG. 24 is a plan view showing still another example of a print head of a printer apparatus to which the present invention is applied.

Furthermore, as shown in FIG. 24, it is also possible to form a plurality of projecting portions 101 among a plurality of sets of nozzles 100 constituted of the first nozzles 104 and the second nozzles 106 arranged adjoining each other at the main surface 108*a* which becomes the printing surface of the orifice plate 108 of the print head. Note that, at this time, it is preferred that a projecting portion 101 be formed also on the outside of the set of nozzles 100 which becomes the front end portion.

Figure 25:
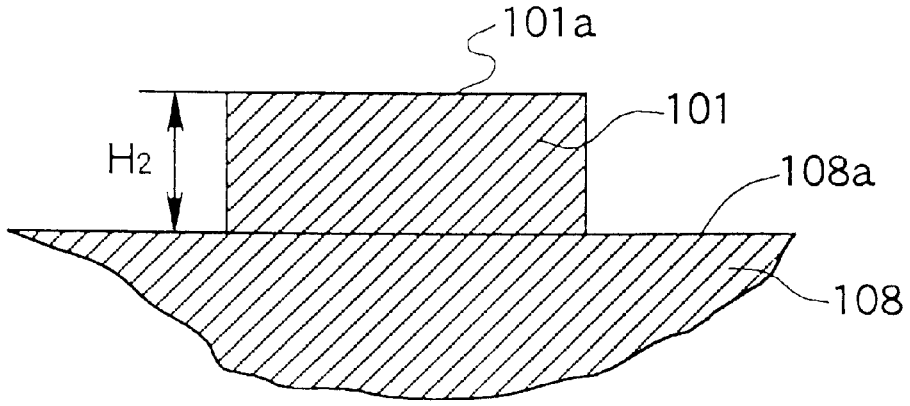
FIG. 25 is a plan view showing the vicinity of the projecting portion of still another example of a print head of a printer apparatus to which the present invention is applied.

Note that, a projecting portion 101 having, for example, a square cross-section in which the side surface which becomes the side on the set of nozzles 100 is formed as the vertical surface, as shown in FIG. 25, is preferred. Preferably the height from the upper surface 101*a* thereof to the main surface 108*a*, indicated by H2 in the figure, is 1 μm or more. The projecting portions 101 may be formed simultaneously when the orifice plate 108 is produced by injection molding or the like.

In such a printer apparatus, the ink discharged from the second nozzle 106 of a set of nozzles 100 does not pass over the projecting portion 101 and is not mixed into the diluent in the first nozzle 104 of the neighboring set of nozzles 100, the interference of the ink between the mutually adjoining sets of nozzles is prevented, the ink and the diluent are mixed with a correct ratio of mixture, and an image having a high precision of density and tones and high resolution is formed.

Further, in the printer apparatus of the present example, dots having a good precision of formation position are formed and an image having a good precision of formation position is formed without exerting an influence upon the direction of discharge of the mixture at the next printing.

Figure 26:
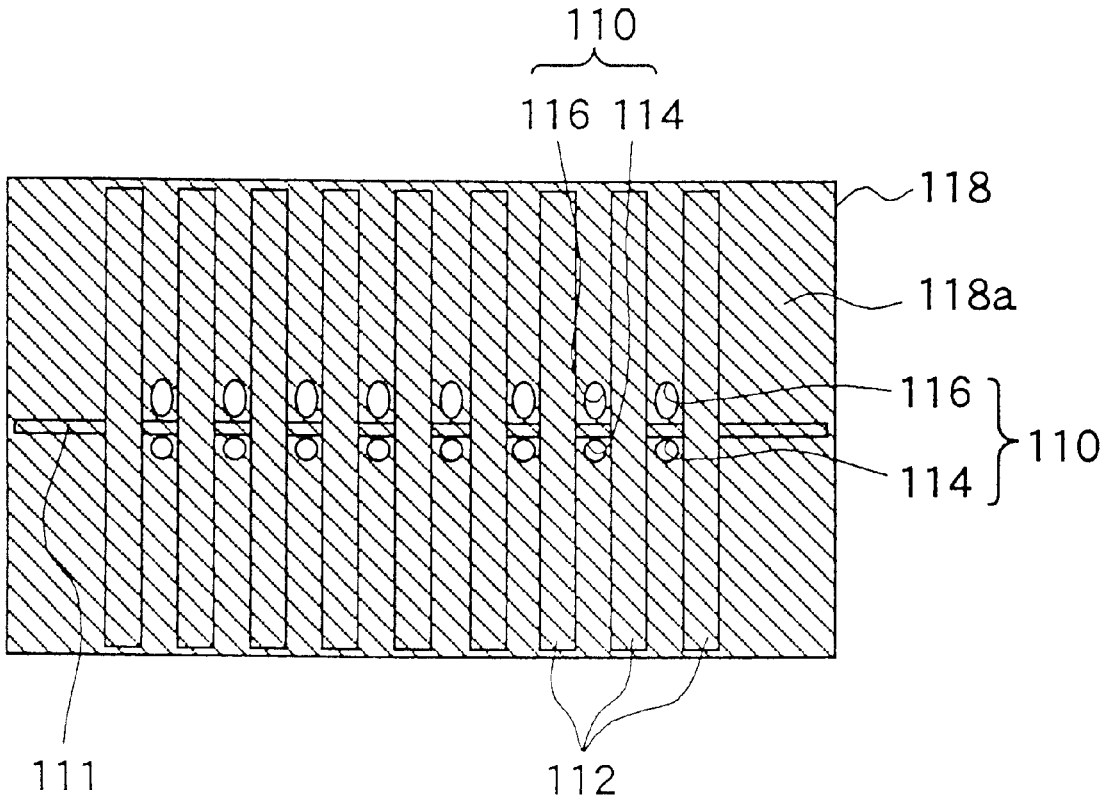
FIG. 26 is a plan view showing still another example of a print head of a printer apparatus to which the present invention is applied.

Furthermore, as shown in FIG. 26, it is possible to apply the liquid repellent treatment, as indicated by the hatching portion in the figure, to the entire surface of main plane surface 118*a* which becomes the printing surface of the orifice plate 118 of the print head, and, at the same time, form the first projecting portions 111 between a plurality of first nozzles 114 of the main surface 118*a* arranged adjoining each other and a plurality of second nozzles 116 arranged adjoining each other, and form a plurality of second projecting portions 112 among a plurality of sets of nozzles 110 constituted of the first nozzles 114 and the second nozzles 116 arranged to be adjacent to each other. Note that, at this time, preferably a second projecting portion 112 is formed also on the outside of the set of nozzles 110 which becomes the front end portion. The first projecting portions 111 and the second projecting portions 112 may be formed simultaneously when the orifice plate 118 is produced by injection molding or the like.

Figure 23:
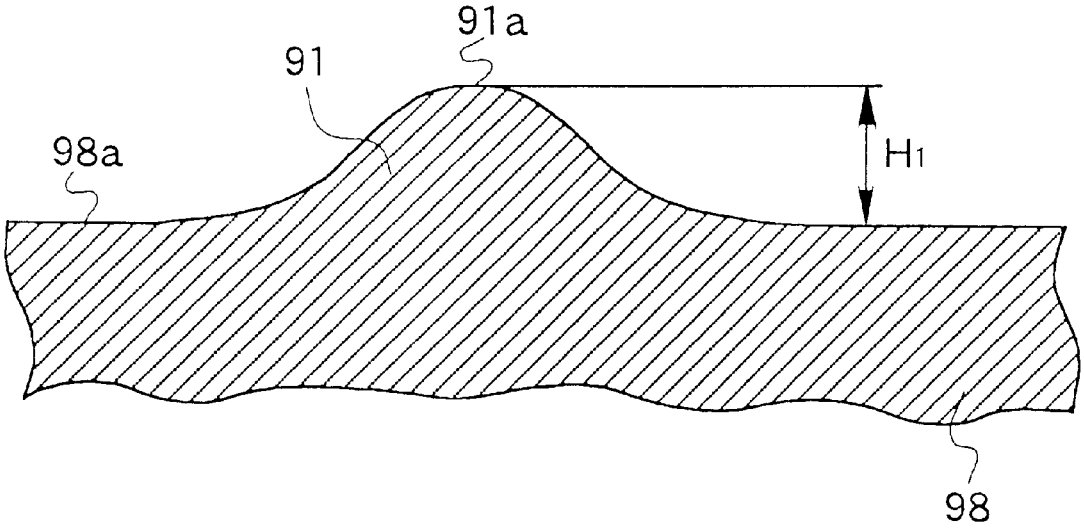
FIG. 23 is a sectional view showing the vicinity of the projecting portion of still another example of a print head of a printer apparatus to which the present invention is applied.

A first projecting portion 111 having a shape similar to that of the projecting portion 91, previously shown in FIG. 23, is preferred. The height thereof may be made equivalent. Further, a second projecting portion 112 having a shape similar to that of the projecting portion 101, previously shown in FIG. 25, is preferred.

The height thereof may be made equivalent as well.

In such a printer apparatus, when extruding the ink to the first nozzle 114 side, when the ink passes over the first projecting portion 111, the ink easily reaches the first nozzle 114 side. Further, when the ink is retracted into the second nozzle 116, the ink is pushed back to the first projecting portion 111, the feed portion and the retracted portion are reliably separated, and the retracted portion easily returns into the second nozzle 116.

Further, at this time, the liquid repellent treatment is applied to the portion between the first nozzle 114 and the second nozzle 116 while containing the first projecting portion 111. When the ink is retracted into the second nozzle 116, the ink is repelled by the liquid repellent treatment and the retracted portion becomes further easy to return into the second nozzle 116.

Further, in such a printer apparatus, the ink discharged from the second nozzle 116 of a set of nozzles 110 does not pass over the second projecting portion 112 and is not mixed into the diluent in the first nozzle 114 of the neighboring set of nozzles 110.

Further, the liquid repellent treatment is applied to the portion between the mutually adjoining sets of nozzles 110 while containing the second projecting portion, the ink is repelled by the liquid repellent treatment, and the sets of nozzles are separated from each other also by this.

Accordingly, from these facts, in the printer apparatus, excessive ink does not remain on the main surface 118*a* of the orifice plate 118, the connection of the ink and diluent between nozzles is prevented, the interference of ink between the mutually adjoining sets of nozzles is prevented, the ink and the diluent are mixed with a correct ratio of mixture at the next printing, and an image having a high precision of density and tones and high resolution is formed.

Figure 27:
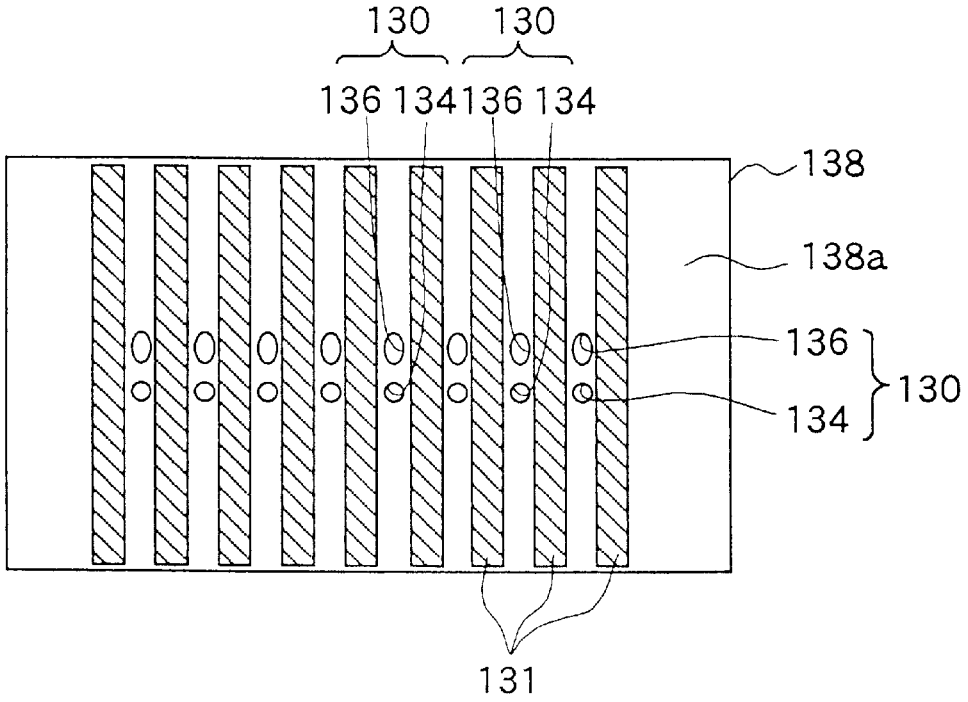
FIG. 27 is a plan view showing still another example of a print head of a printer apparatus to which the present invention is applied.

Further, as shown in FIG. 27, it is also possible to form a plurality of recessed portions 131, indicated by the hatching portions, among a plurality of sets of nozzles 130 constituted by the first nozzles 134 and the second nozzles 136 arranged adjoining each other on the main surface 138*a* which becomes the printing surface of the orifice plate 138 of the print head.

Figure 28:
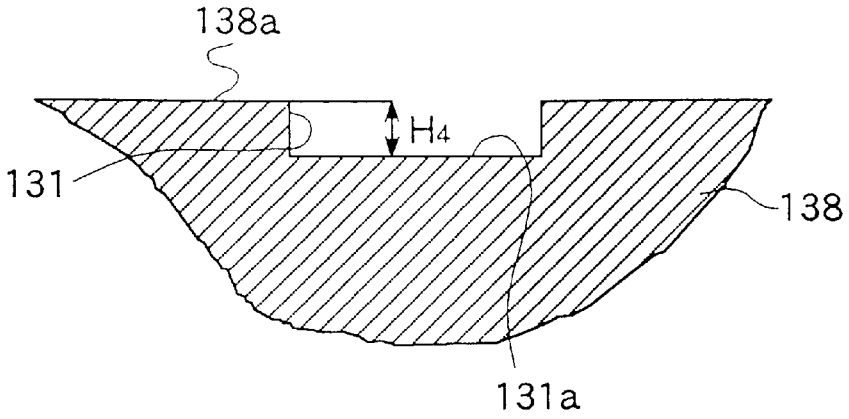
FIG. 28 is a plan view showing the vicinity of the recessed portion of still another example of a print head of a printer apparatus to which the present invention is applied.

Note that a recessed portion 131 having, for example, a substantially wide U-shape in which the side surface located on the side of the set of nozzles 130 is made a vertical surface, as shown in FIG. 28, is preferred. Preferably the depth from the bottom surface 131*a* thereof to the main surface 138*a,* indicated by H4 in the figure, is 1 $\mu$m or more. Such recessed portions 131 may be formed simultaneously when the orifice plate 138 is produced by injection molding or the like.

In such a printer apparatus, the ink discharged from the second nozzle 136 of a certain set of nozzles 130 is not mixed into the diluent in the first nozzle 134 of the neighboring set of nozzles 130, the interference of the ink between the mutually adjoining sets of nozzles is prevented, the ink and the diluent are mixed at a correct ratio at the next printing, and an image having a high precision of density and tones and high resolution is formed.

Further, in the printer apparatus of the present example, dots having a good precision of formation position are formed and an image having a good precision of formation position is formed without exerting an influence upon the direction of discharge of the mixture at the next printing.

In the print head mentioned heretofore, a description was made of an example of simultaneously forming the projecting portions and recessed portions when the orifice plate is injection-molded, but it is also possible to form these projecting portions and recessed portions by utilizing the liquid repellent treatment of the orifice plate. Namely, if, for example, the projecting portions are to be formed, the liquid repellent treatment may be carried out only for the projecting portion-forming parts of the orifice plate in an overlapped manner and to form the projecting portions by the laminated liquid repellent treated portions. Further, if the recessed portions are to be formed, the liquid repellent treatment may be carried out for the entire surface of the main surface which becomes the printing surface except only the recessed portion-forming parts of the orifice plate in overlapped manner and to form the recessed portions by the laminated liquid repellent treated portions.

Further, heretofore, a description was made of the example of a printer apparatus having a print head having an orifice plate as the printer apparatus. The present invention can be applied also with respect to a printer apparatus having so-called end surface type print head not having the orifice plate as will be shown below.

In a print head having the orifice plate mentioned heretofore, a nozzle and an introduction port communicated with this were formed in the orifice plate so that they penetrated through the orifice plate, pressure chamber side walls made of a dry film resist or the like were formed on the introduction port side of the orifice plate in a laminated manner, and the pressure chamber was formed by the portion where the pressure chamber side walls were not formed.

Figure 29:
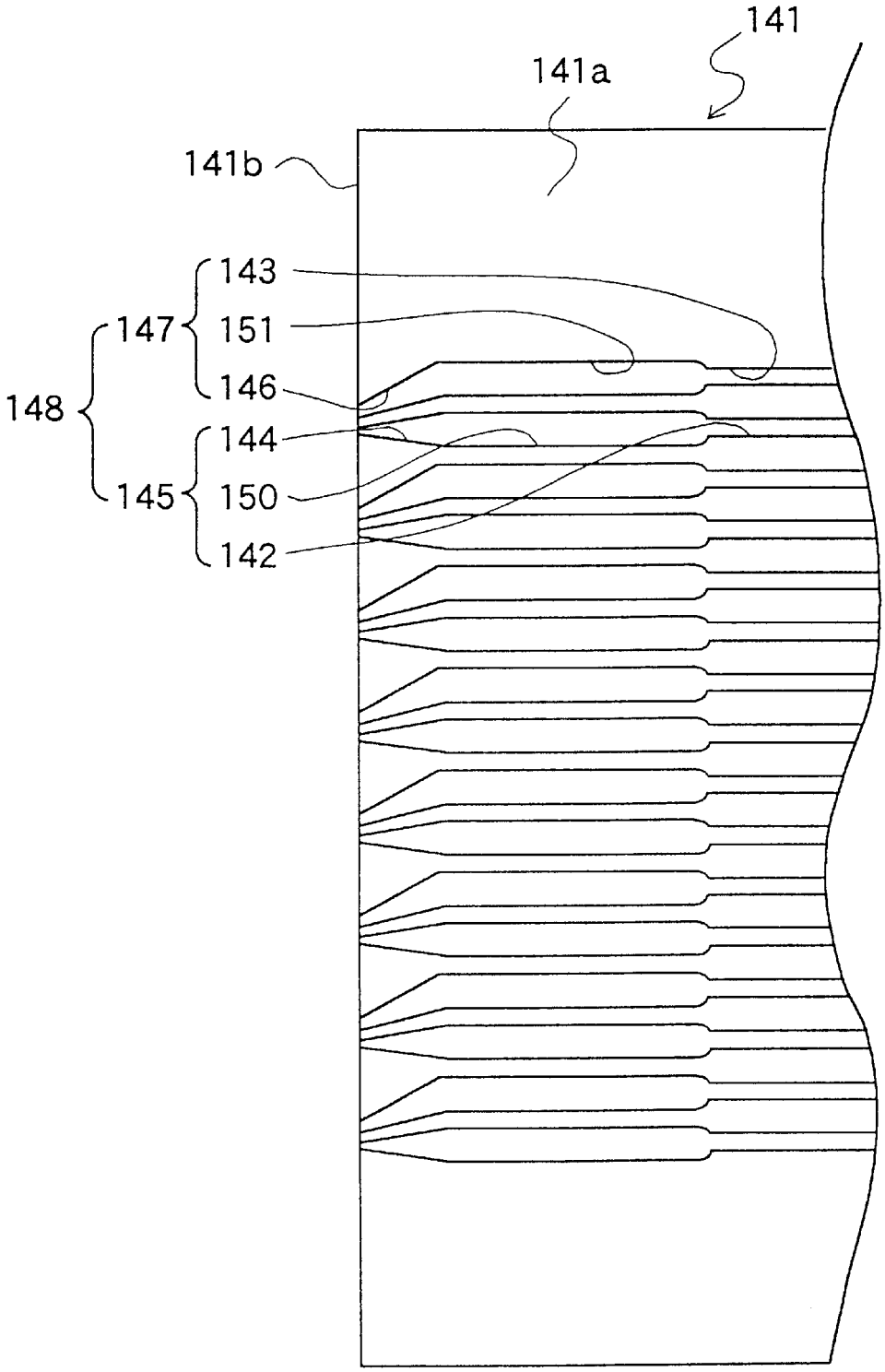
FIG. 29 is a schematic plan view of principal parts showing in an enlarged manner the vicinity of the discharging portion of the plate member of another example of a print head of a printer apparatus to which the present invention is applied.

Contrary to this, in the end surface type print head, for example as shown in FIG. 29, a plurality of sets of discharging portion 148 each being constituted by a first discharging portion 145 which is a groove portion in which a first nozzle portion 144, a first pressure chamber portion 150, and a first capillary tube portion 142 are formed so as to be communicated and a second discharging portion 147 which is a groove portion in which a second nozzle portion 146, a second pressure chamber portion 151, and a second capillary tube portion 143 are formed so as to be communicated are arranged inside the surface so as to be adjacent to each other so that the opening portion faces the main surface 141*a* side of the plate member 141. Note that, needless to say the end portions of the first and second nozzle portions 144 and 146 face to the main surface 141*b* which becomes the printing surface.

Figure 30:
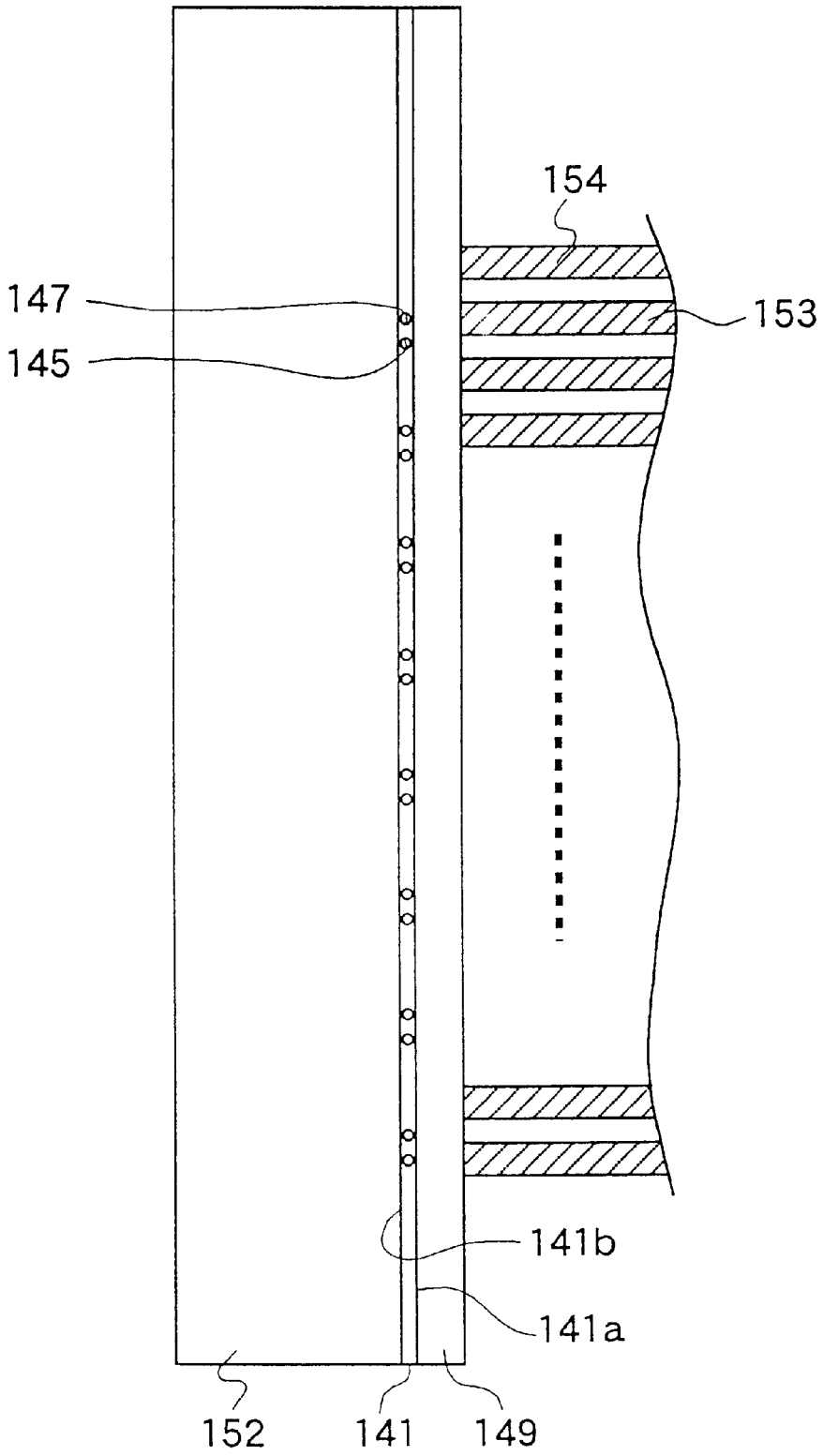
FIG. 30 is a side view diagrammatically showing another example of a print head of a printer apparatus to which the present invention is applied.

Then, as shown in FIG. 30, a vibrating plate 149 is placed on the main surface 141*a* side of the plate member 141 to close the first and second discharging portions 145 and 147 and, at the same time, a base plate 152 is placed oh the main surface 141*b* side opposite to the main surface 141*a* of the plate member 141 to sandwich the plate member 141 between the vibrating plate 149 and the base plate 152. Further, a first laminated piezoelectric element 153 is arranged at the position corresponding to the first pressure chamber portion of the first discharging portion 145, and a second laminated piezoelectric element 154 is arranged at the position corresponding to the second pressure chamber portion of the second discharging portion 147. Needless to say these first and second piezoelectric elements 153 and 154 are supported by the supporting member, respectively, affixed to the holder, and respectively form the piezoelectric element units.

Figure 31:
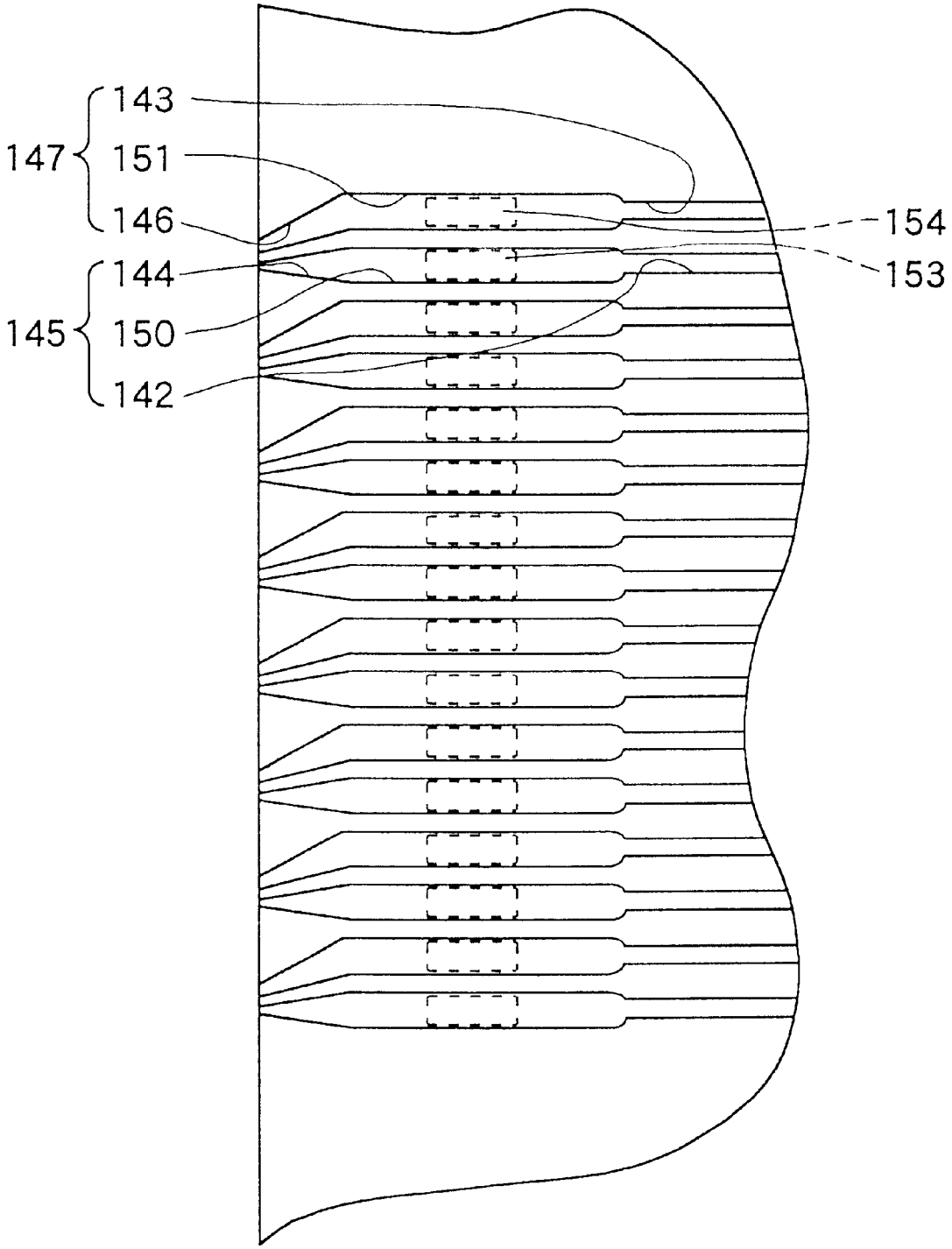
FIG. 31 is a schematic plan view of principal parts showing in an enlarged manner the relationship between the pressure chamber and the laminated piezoelectric element of another example of a print head of a printer apparatus to which the present invention is applied.

Namely, in this print head, as shown in FIG. 31, it is made possible to pressurize the first pressure chamber portion 150 of the first discharging portion 145 by the first laminated piezoelectric element 153 and pressurize the second pressure chamber portion 151 of the second discharging portion 147 by the second laminated piezoelectric element 154. Accordingly, when the first capillary tube portion 142 of the first discharging portion 145 is connected to the diluent supply portion and the second capillary tube portion 143 of the second discharging portion 147 is connected to the ink supply portion, by the pressurizing to the first and second pressure chambers 150 and 151 of the first and second laminated piezoelectric elements 153 and 154, the mixed discharge of the diluent and ink becomes possible similar to the print head having the orifice plate.

Note that, in the example heretofore, a description was made of a "carrier jet" system printer apparatus, but needless to say the present invention can be applied also to a density modulation type ink jet system printer apparatus in which the ink and diluent are discharged while mixing the diluent into the ink.

In the density modulation type ink jet system printer apparatus, the expression of the low density is inferior to the "carrier jet" system printer apparatus, but a sufficient ink concentration can be obtained in the high density part.

Further, in any of the "carrier jet" system and the density modulation type ink jet system, a so-called continuous tone recording is possible. Accordingly where particularly the printing of a photographic image etc. is carried out, a smooth expression of gradation is possible, so this is preferred.

What is claimed is:

1. A printer apparatus comprising:

a print head having a printing surface;

a first pressure chamber into which a discharge medium is introduced;

a second pressure chamber into which a feed medium is introduced; and a plurality of sets of nozzles, each set of nozzles including a first nozzle and a second nozzle, the first nozzle being in communication with the first pressure chamber and the second nozzle being in communication with the second pressure chamber;

wherein, each of said first nozzle and said second nozzle has an opening on said printing surface, said discharge medium and feed medium are mixed on said printing surface, and a liquid repellant treatment is provided on said printing surface, said liquid repellant treatment being effective to separate said discharge medium and feed medium during a non-discharge state.

2. A printer apparatus as set forth in claim 1, wherein the liquid repellent treatment is applied to an entire surface of said surface of the print head.

3. The printer apparatus as set forth in claim 1, wherein an area between the first nozzle and second nozzle is a first portion and an area between at least two sets of nozzles is a second portion, and a projecting portion is formed on at least one of the first and second portions.

4. The printer apparatus as set forth in claim 1, wherein at least two sets of the plurality of sets of nozzles are adjacent one another and a recessed portion is formed between the adjacent sets of nozzles.

5. The printer apparatus as set forth in claim 1, wherein said first nozzle extends perpendicular from said printing surface, and said second nozzle extends from said printing surface away from said first nozzle, said first nozzle and said second nozzle forming an angle $\ominus$.

6. A method of manufacturing a printer apparatus comprising the steps of, providing a print head having a printing surface;

providing a plurality of pairs of first and second nozzles behind the printing surface and connecting each of said first and second nozzles to respective first and second chambers, wherein each of said first and second nozzles has an opening on the printing surface for mixing an ink and a diluent on the printing surface;

applying a liquid repellant treatment at least on the printing surface between said first and second nozzles; and forming a projecting portion at least between adjacent members of said plurality of pairs of first and second nozzles.

* * * * *